US011118793B2

(12) United States Patent
Olsen

(10) Patent No.: US 11,118,793 B2
(45) Date of Patent: Sep. 14, 2021

(54) AIR CONDITIONING UNIT

(71) Applicant: Ove Arup & Partners International Limited, London (GB)

(72) Inventor: Roger Olsen, London (GB)

(73) Assignee: OVE ARUP VENTURES LIMITED, London (GB)

( * ) Notice: Subject to any disclaimer, the term of this patent is extended or adjusted under 35 U.S.C. 154(b) by 616 days.

(21) Appl. No.: 15/501,019

(22) PCT Filed: Jul. 31, 2015

(86) PCT No.: PCT/GB2015/052221
§ 371 (c)(1),
(2) Date: Feb. 1, 2017

(87) PCT Pub. No.: WO2016/016659
PCT Pub. Date: Feb. 4, 2016

(65) Prior Publication Data

US 2018/0180304 A1 Jun. 28, 2018

(30) Foreign Application Priority Data

Aug. 1, 2014 (GB) ..... 1413709

(51) Int. Cl.
*F24F 1/0014* (2019.01)
*F24F 1/0047* (2019.01)
(Continued)

(52) U.S. Cl.
CPC ..... *F24F 1/0014* (2013.01); *F24F 1/0011* (2013.01); *F24F 1/0022* (2013.01);
(Continued)

(58) Field of Classification Search
CPC ..... F24F 1/0047; F24F 1/0022; F24F 1/0014; F24F 1/0053; F24F 1/0057
(Continued)

(56) References Cited

U.S. PATENT DOCUMENTS 3,766,750 A * 10/1973 Aoh ..... F24F 1/02 62/259.1
2005/0111972 A1* 5/2005 Penlesky ..... F04D 29/4226 415/206
(Continued)

FOREIGN PATENT DOCUMENTS

CN 1502936 A 6/2004
JP 1973035562 U 10/1973
(Continued)

OTHER PUBLICATIONS

Feng Yuqi et al.; "New Manual for the Installation and Maintenance of Air-Conditioning Refrigeration Equipment"; Aerospace Press, Apr. 1994; 5 pages (translation 3 pages).

*Primary Examiner* — Vivek K Shirsat
(74) *Attorney, Agent, or Firm* — Gearhart Law LLC; David Postolski, Esq.

(57) ABSTRACT

An air conditioning unit (2) comprises a main body (3) including an air inlet (24) and an air outlet (22), the main body (3) defining an airflow passage between the air inlet (24) and the air outlet (22). A fan (28) is disposed within the airflow passage and a thermal element (26) is disposed within the airflow passage upstream of the fan (28). The main body (3) has a front face exposed to a temperature controlled space (8), on which the air outlet is disposed, and the air inlet and thermal element are disposed around the periphery of the front face.

18 Claims, 18 Drawing Sheets

(51) Int. Cl.

| | |
|---|---|
| ***F24F 1/0053*** | (2019.01) |
| ***F24F 1/0057*** | (2019.01) |
| ***F24F 13/22*** | (2006.01) |
| ***F24F 1/0011*** | (2019.01) |
| ***F24F 13/32*** | (2006.01) |
| ***F24F 1/0063*** | (2019.01) |
| ***F24F 1/0073*** | (2019.01) |
| ***F24F 1/0022*** | (2019.01) |

(52) U.S. Cl.
CPC ..... *F24F 1/0047* (2019.02); *F24F 1/0053* (2019.02); *F24F 1/0057* (2019.02); *F24F 1/0063* (2019.02); *F24F 1/0073* (2019.02); *F24F 13/222* (2013.01); *F24F 13/32* (2013.01); *F24F 2221/40* (2013.01)

(58) Field of Classification Search
USPC ..... 454/186
See application file for complete search history.

(56) References Cited

U.S. PATENT DOCUMENTS

2009/0170421 A1* 7/2009 Adrian ..... F24F 7/06 454/349
2011/0240255 A1* 10/2011 Sakashita ..... F24F 1/0007 165/53

FOREIGN PATENT DOCUMENTS

| | | | |
|---|---|---|---|
| JP | 1996082438 | A | 3/1996 |
| JP | 2002005469 | A | 1/2002 |
| JP | 2010249401 | A | 11/2010 |
| JP | 2004176930 | A | 9/2011 |
| JP | 2011169495 | A | 9/2011 |
| JP | 2013088013 | A | 5/2013 |

* cited by examiner

Section

Plan

VIEW FROM BELOW

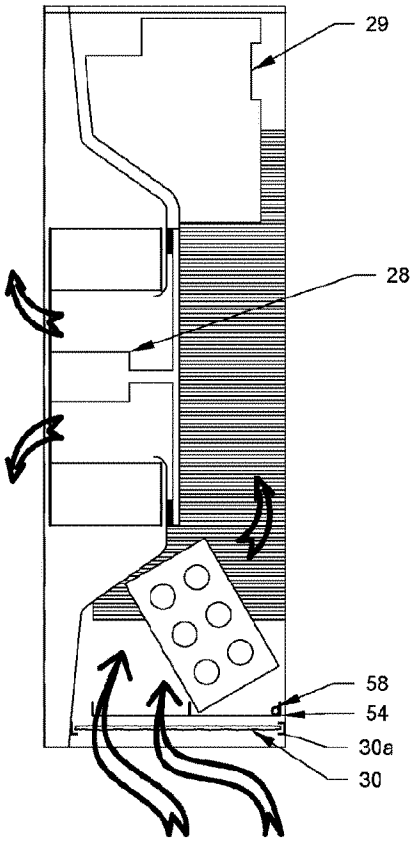
Fig 24B: Section B-B
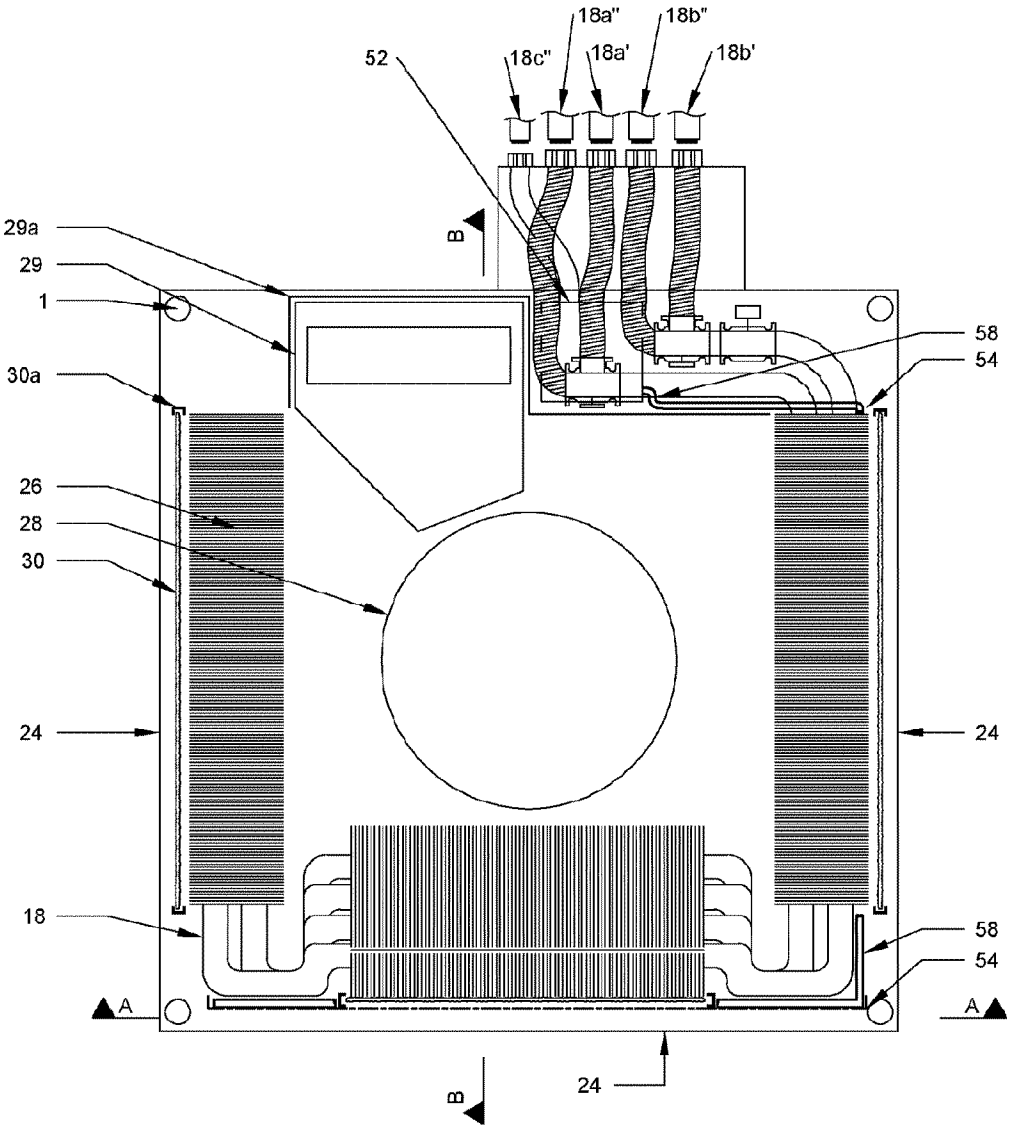
Fig 24A: Elevation

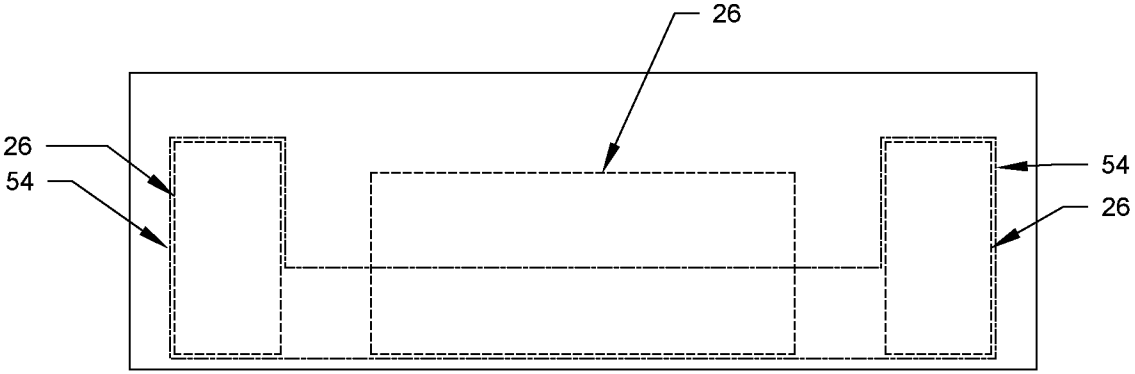
Fig 24C: Plan A-A

AIR CONDITIONING UNIT

This application is a national application of PCT-application PCT/GB2015/05221 filed on Jul. 31, 2015, which claims priority of Great Britain national application number 1413709.5 filed on Aug. 1, 2014, both of which are incorporated herein by reference.

The present invention relates to an air conditioning unit, and particularly to a low profile, highly efficient, fan coil unit.

Fan coil units are one of the most popular types of air conditioning unit in the world, and can be found in residential, commercial, and industrial buildings. A fan coil unit is essentially a device comprising a heating or cooling coil and fan. Due to their simplicity, fan coil units are often more economical to install than ducted cooling and heating systems with air handling units. However, they can be noisy because the fan is within the temperature controlled space. Furthermore, if the fan coil unit or an 'all air' system is installed within a suspended ceiling, it can require large floor to floor heights to provide the space to accommodate the fan coil unit. They can also complicate maintenance as the suspended ceiling must be removed to access the unit.

A cassette air conditioning unit is a form of fan coil unit in which ceiling mounted cassettes are mounted in a ceiling void so that only a fascia is visible. The internal unit incorporates a cooling or heating coil and directional flaps allow air to be distributed around a room in 2, 3, or 4 different directions.

Viewed from a first aspect, the present invention provides an air conditioning unit, comprising: a main body including an air inlet and an air outlet, the main body defining an airflow passage between the air inlet and the air outlet; a fan disposed within the airflow passage; and a thermal element disposed within the airflow passage upstream of the fan, wherein the main body has a first face on which the air outlet is disposed, and wherein the air inlet and thermal element are disposed at the periphery of the first face.

The air inlet and thermal element are preferably disposed only at the periphery of the first face.

This arrangement provides for an airflow velocity at the thermal element that is lower, for a given total airflow through the fan, than the airflow velocity at the thermal element in prior art arrangements where the air inlet and thermal element are central on the face of the unit/central within the body of the unit. A greater surface area is available at the periphery of the first face than at a more central location.

Preferably the air inlet and thermal element extend along at least 50% of the periphery of the first face, and more preferably at least 70% of the periphery of the first face. In preferred embodiments, the periphery of the first face may also include space for connections to building utilities such as electrical power and/or incoming/outgoing working fluid for the thermal element. It is preferred for the thermal element and air inlet to extend around the entirety of the available space about the periphery of the first face, which in the case above would be the space not required for connection to building utilities.

Preferably the air inlet, the air outlet and the airflow passage are arranged such that, in use, the airflow velocity through the airflow passage at the thermal element is less than 50%, preferably less than 30%, of the airflow velocity through the airflow passage downstream of the fan, e.g. at an output of the fan. Where there is relatively little pressure increase caused by the fan, this is approximately equivalent to the airflow passage cross-sectional area at the thermal element being at least twice, preferably at least three times, that of the airflow passage cross-sectional area at the output of the fan.

In a preferred embodiment, the air conditioning unit may be arranged such that, when the fan is driven to give an air output velocity of about 0.8 metres/second at the first face, the airflow velocity through the airflow passage at the thermal element is between 0.5 and 1.5 metres/second, and preferably about 0.5 to 0.7 metres/second. This is much lower than in most fan coil units, which operate at an air velocity of around 2.5 metres/second at the cooling coils.

This configuration, which takes advantage of the reduced airflow velocity at the thermal element discussed above, both reduces the pressure drop across the thermal elements and increases the thermal transfer rate between the thermal elements and the airflow. Hence, the heat transfer efficiency can be increased, whilst also reducing the work required to be performed by the fan.

The main body may comprise one or more second faces extending from the periphery of the first face, and the air inlet may be disposed on the second face(s).

The one or more second faces are preferably generally perpendicular (e.g. within about 30° of perpendicular) to the first face. The second face(s) hence may essentially be side faces of the unit, with the first face being a front face. Any number of side faces may be provided, for example where the main body is rectangular there will be four side faces. Other shapes may also be used, for example an air conditioning unit having a triangular shape would have three side faces.

The first face may be a front plate of the air conditioning unit. In this context, the front plate is the portion of the air conditioning unit facing into the temperature controlled space. Thus, preferably the first face is adapted so as to be exposed, in use, to a temperature controlled space.

In preferred embodiments, the first face of the air conditioning unit is rectangular, preferably having a width of less than 600 mm and a length of less than 600 mm. The main body of the air conditioning unit is preferably generally cuboid. This enables the main body to be conveniently installed in a standard ceiling grid. With a generally cuboid shape the second faces would be sides of the cuboid, extending away from the sides of the rectangular first face and being generally perpendicular to the surface of the first face.

Preferably the main body of the air conditioning unit has a thickness of less than 300 mm, more preferably less than 250 mm and most preferably 200 mm or less. Conventional fan coil units have not been able to achieve such thicknesses. However, the arrangement of the present invention allows these low thicknesses to be achieved.

In some embodiments, the thermal element may comprise a thermal coil for heat exchange with air flowing across the coil, such as a water-cooled coil. This may be arranged either in a cooling only ('2-pipe') coil configuration or a cooling and heating ('4-pipe') coil configuration. The thermal element may further comprise heat exchange fins adjacent to the air inlet, so as to maximise heat transfer between the coil and the air.

In alternative embodiments, the thermal element may instead be a chilled beam for heat exchange with air flowing through the chilled beam.

Preferably the fan is oriented such that a rotational axis of the fan is substantially perpendicular to the first face. This allows a relatively large diameter fan to be used without increasing the thickness of the main body of the unit (i.e. the distance from the front face to the rear of the main body). In some embodiments, the diameter of the fan may be greater than 200 mm. It will be noted that the preferred placement of the fan on the first face and at a centre of the unit allows for maximum space for a large diameter of fan, without restricting the space available for the air inlet and thermal elements, which are at the periphery around the fan.

The fan is preferably a plug fan. Plug fans having lower pressure drops and noise output than the tangential or centrifugal fans which are normally used in fan coil units.

The fan preferably vents air directly into the temperature-controlled space. This is contrary to the arrangement of most traditional fan coil units, where the fan vents the air through further downstream components, such as diffuser fins, secondary ducting, and so on.

The fan may also be configured to provide a swirl effect to the air output into the temperature-controlled space. That is to say, the air discharges straight from the tips of the fan blades in a pattern that spreads out in a circular flow. Although a similar effect can be achieved in conventional units using a swirl diffuser, this causes energy loss as the airflow is redirected by blades. The swirl effect causes a high induction air flow, which is desirable because it can introduce cold air into a conditioned space with less risk of draughts. Using the fan to provide the swirl effect rather than by blades minimises changes in direction for the air, and minimises energy loss.

The impellors of the fan may include a ramp at their tips, just before the discharge, to increase the downward velocity of the air. This can help to achieve the preferred high induction air pattern. In some embodiments, turning vanes may be included in the airflow passage upstream of the fan to smooth the airstream, reduce friction and reduce the pressure drop at the bend between the air inlet and the fan.

The air conditioning unit, as detailed in any of the above statements, may be arranged to be mounted vertically, i.e. with the first face extending substantially vertically. In such a configuration, if the periphery of the first face includes space for connections to building utilities such as electrical power and/or incoming/outgoing working fluid for the thermal element, this space will be provided on an upper substantially horizontally extending peripheral side of the first face. The thermal element and air inlet will extend around substantially the entirety of the available space about the periphery of the first face, which in this case would be the space not required for connection to building utilities, i.e. the space about the lower substantially horizontally extending peripheral side and about the substantially vertically extending peripheral sides of the first face. In such an arrangement, the portion of the thermal element extending along lower substantially horizontally extending peripheral side of the first face may be provided at an oblique angle to the vertical/front face, preferably at an angle of around 30 degrees.

In one preferred embodiment, the thermal element is mounted to a first housing portion of the main body and the fan is mounted to a second housing portion of the main body, the second housing portion being hinged with respect to the first housing. As a result, the second housing portion may be rotatable via the hinge with respect to the first housing portion from a first position to a second position, wherein the fan is operable for normal use in the first position and is accessible for maintenance in the second position. Preferably the second housing portion includes the first face and is adapted so as to be exposed, in use, to the temperature controlled space.

Thus, the air conditioning unit may allow 'self-access'. That is to say, components of the air conditioning unit requiring access (e.g. for maintenance), such as the fan and filters, can be reached simply by unlatching and rotating the second housing, rather than for example requiring removal of ceiling tiles and disassembly or removal of the fan coil unit, as is presently required. As the rotatable second housing portion remains attached to the rest of the unit, which is attached to the ceiling or other support, then maintenance can be carried out in situ without the need to disconnect the power supply or heat/cooling source.

The air conditioning unit may include an air filter in the airflow passage upstream of the fan, and preferably also upstream of the thermal element.

The filter is preferably arranged within the main body such that it cannot be removed from the main body when the second housing portion in the first position and can be removed from the main body when the second housing portion is in the second position. In some arrangements, the filter may be releasably mounted within the first housing portion.

The air conditioning unit preferably further comprises a drip tray arranged so as to be, in use, vertically below at least the thermal element. Where multiple thermal elements are provided, the drip tray will overlap with all of the vertical elements. The drip tray is thus configured to catch condensate that forms on the thermal element when operating in a cooling mode. When any of the thermal elements is provided at an oblique angle to the vertical, as for example when the air conditioning unit is arranged to be mounted vertically, the drip tray may only partially overlap with the angled thermal element to leave a free space for the flow of outside air to the angled thermal element through a lower horizontally extending second face. Condensate will run down the angled face to collect in the drip tray. The drip tray (or one or more additional drip trays) may also be provided under further chilled components of the air conditioning unit, such as cooling medium valves and pipes connecting to the thermal element.

The or each drip tray preferably contains a hydrophilic member, such as a tube formed of hydrophilic material, which is disposed within the drip tray to collect condensate caught by the drip tray. The use of a hydrophilic material allows water to be drawn into the material, avoiding the need for gravity drainage, which would increase the thickness of the air conditioning unit. Instead, the condensate can be drawn via the member along a drip tray that is substantially horizontal along its length, or even up a slight incline in situations where the air conditioning unit is not installed perfectly level.

The drip tray may have a sloped floor arranged to, in use, direct the condensate toward the hydrophilic member. This allows a smaller hydrophilic member to be used without significantly increasing the thickness of the unit. Preferably the drip tray is elongate and the slope is perpendicular to the longitudinal direction of the tray, i.e. so as to direct the condensate toward an elongate hydrophilic member running substantially the length of the drip tray. Preferably the drip tray is arranged so as to be substantially horizontal, in its longitudinal direction in use. As the air conditioning unit is preferably very thin, a steep gradient cannot be provided across the entire length of the drip tray to drain condensate to a single drainage location. Instead, a local gradient directs the condensate to the hydrophilic member, which collects the condensate.

The air conditioning unit may further comprise a pump arranged to draw the condensate along the hydrophilic member. In some embodiments, a moisture detector, such as moisture detection tape, may be provided adjacent to the hydrophilic member, and the pump may then be arranged to activate when moisture is detected by the moisture detector. Thus, when the hydrophilic member is saturated with condensate, the unabsorbed moisture will be detected and the pump will activate, e.g. for a predetermined period of time, to drain the moisture absorbed by the hydrophilic member. This then minimises the time the pump is active, reducing the energy required for the pump and any pump noise. The pump will be arranged to have minimal noise when running.

The air conditioning unit preferably further comprises: an installation frame adapted to be mounted to the ceiling during a first fix and comprising isolatable connections for services of the air conditioning unit to be connected, wherein the main body is adapted to be mounted to the installation frame during a second fix.

By this arrangement, the installation frame can be installed during the first fix and the services, such as power lines, control lines and/or cooling/heating medium pipework, can be connected to the isolatable connections. Then, at a later time during a second fix, the main body of the air conditioning unit can be installed. This means that workflow can be optimised as the various services need merely be connected to the installation frame when they are installed in the ceiling. This is more efficient than fitting them all at the same time as the air conditioning unit is installed, as it gives flexibility for different trades to attend to make connections at different times.

In one embodiment, a method of installing the air conditioning unit comprises: fixing the installation frame to a ceiling; installing ceiling services, terminating at the isolatable connections of the installation frame; installing a suspended ceiling; and mounting the main body of the air conditioning unit onto the installation frame.

In some embodiments, the air outlet may be adapted to receive a light emitting device. That is to say, it may include for example light fittings for lamps to be inserted. The output air is then output around the light allowing the air conditioning unit to provide a dual function. The air outlet may further be arranged to act as a light diffuser for the light emitting device.

In some embodiments, the air conditioning unit may be adapted to be suspended from a ceiling, for example as a pendant. This may be appropriate for retail use, or restaurants, with exposed ceilings. There is also a move in office design towards removing suspended ceilings and having exposed services and suspended units. In such an embodiment, the main body may include second faces that are hinged to permit access.

Where the air conditioning unit is adapted to be suspended, the unit may further comprise a rim member surrounding the main body. Preferably rim member has an outer edge having a height less than 60% of the thickness of the main body. The rear of the rim member will be hard to see from below, this giving the illusion of a slim unit.

The rim member may include additional services, such as lights, fire detectors, sprinklers, public announcement facilities, and so on, thus allowing the air conditioning unit to act as a multiservice unit.

An embodiment of invention can also be seen to provide a structure including the air conditioning unit, wherein the structure comprises a floor, a ceiling and a temperature controlled space defined between the floor and the ceiling, and wherein the main body of the air conditioning unit is disposed within a ceiling void of the ceiling such that the first face is exposed to the temperature controlled space.

In some embodiments, the structure is arranged such that air is drawn into the temperature controlled space via a floor void of the floor.

An alternative embodiment of the invention can be seen to provide a structure including the air conditioning unit, wherein the structure comprises a floor, a ceiling, a vertical wall and a temperature controlled space defined between the floor, the ceiling and the wall, and wherein the main body of the air conditioning unit is disposed within the vertical wall such that the first face is vertical and exposed to the temperature controlled space. The vertical wall may include a void adjacent the air inlet of the air conditioning unit, the cavity being in gaseous communication with the temperature controlled space.

In this arrangement, the vertically-mounted air conditioning unit can be installed into a wall. The low profile of the air conditioning unit enables it is be installed in the wall without unduly limiting the space within the room. This configuration may be particularly well suited to a small computer room, such as an SER (Small equipment Room) or SCR (Sub Comms Room).

The condensate removal features described above are considered to be novel and inventive in their own right. Hence, viewed from another aspect, the invention provides a condensate removal system for an air conditioning unit, comprising: a hydrophilic member; a pump arranged to draw condensate along the hydrophilic member; a drip tray for collecting condensate and directing the condensate, in use, toward the hydrophilic member; and a moisture detector arranged adjacent the hydrophilic member, wherein the pump is arranged to activate when moisture is detected by the moisture detector.

The use of a hydrophilic member allows condensate to be drawn into the material providing the advantages discussed above.

The drip tray may have a sloped floor as described above to, in use, direct the condensate toward the hydrophilic member.

The condensate removal system may advantageously be combined with an air conditioning system of the type described above, but it also provides advantages with other air conditioning systems. This is because the depth/height required to house a condensate removal system is reduced by the system of this aspect. Thus, any air conditioning unit can be redesigned to have a lower profile, and a condensate removal system can be included even when space is limited. It can be a significant advantage to allow for an air conditioning unit to have a 'wet' mode, since it increases the range of temperature and humidity within which the unit can operate. In addition, the condensate removal system can be more effective at gathering condensate due to the use of hydrophilic materials. This reduces the risk of drips, leakage or flooding.

The use of a rotatable second housing portion is also considered novel and inventive in its own right. Thus, viewed from yet another aspect, the invention provides an air conditioning unit, comprising: a thermal element mounted to a first housing portion; and a fan mounted to a second housing portion, the second housing portion being hinged with respect to the first housing, wherein the second housing portion is rotatable with respect to the first housing portion via the hinge from a first position to a second position; and wherein the fan is operable in the first position and is accessible for maintenance in the second position. Preferably the second housing portion includes the first face and is adapted so as to be exposed, in use, to a temperature controlled space.

Advantageously, this air conditioning unit allows 'self-access', as described above.

The unit of this aspect or the preceding aspect may be combined, either together or alone, with any or all of the features described above in connection with the first aspect of the invention, with or without the features of the first aspect itself.

Certain preferred embodiments of the present invention will now be discussed in greater detail, by way of example only and with reference to the accompanying drawings, in which:

FIG. 24A shows a sectional front view through yet another alternative air conditioning unit, which is arranged to be vertically mounted;

FIG. 24B shows a sectional side view of the air conditioning unit of FIG. 24A;

FIG. 24C shows a sectional plan view of the air conditioning unit of 24A, which shows detail of a condensate removal system therein

Figure 1:
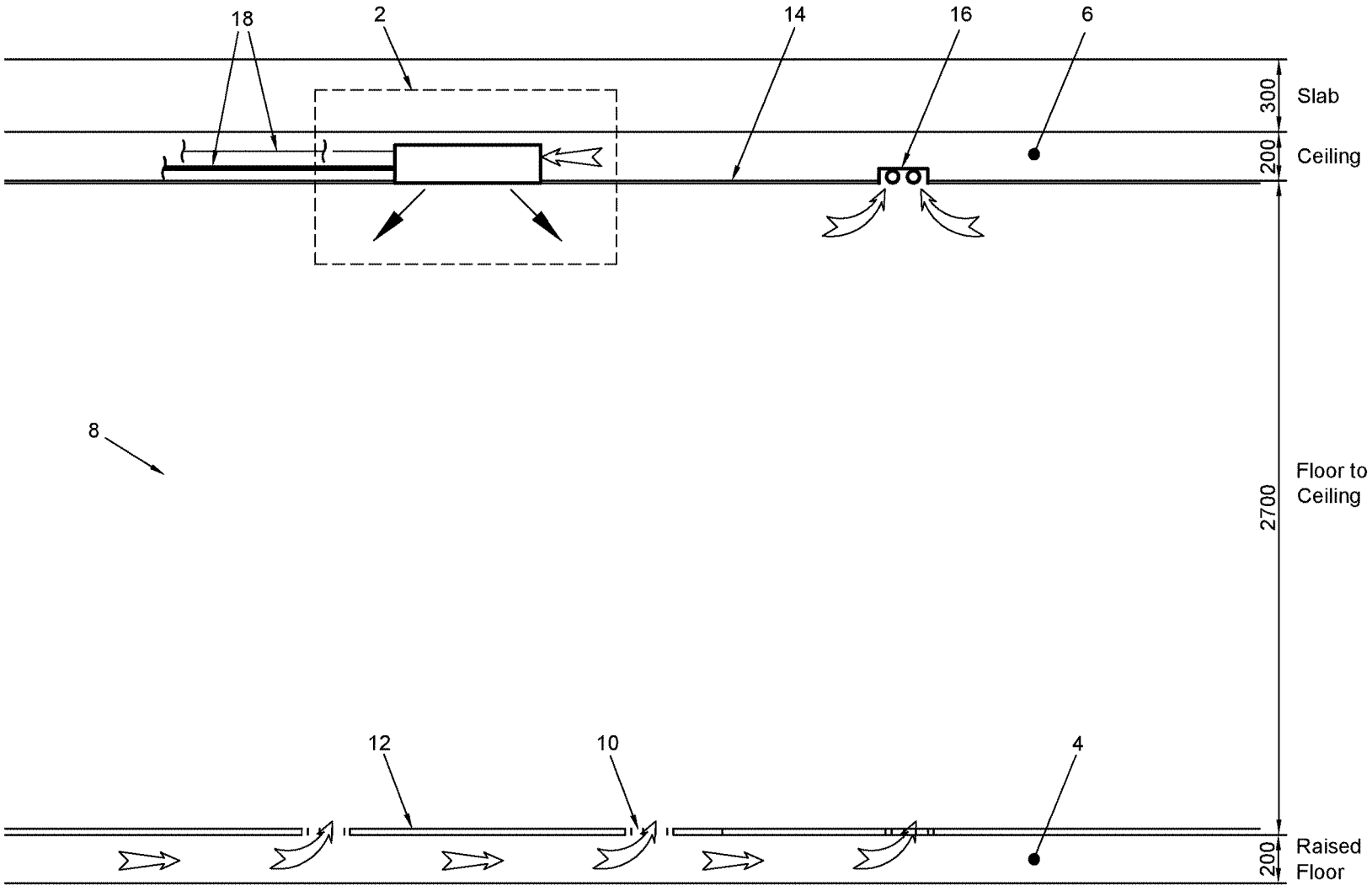
FIG. 1 shows a cross section through a building illustrating airflow from an air conditioning unit.

FIG. 1 shows a cross section through an exemplary building illustrating airflow through an air conditioning unit 2. It should be noted that whilst the detailed description herein focusses on the use of such air conditioning units in buildings, they may equally be suitable for transport applications, such as coaches and railway carriages, or otherwise, due to their low height. The building uses a floor plenum 4 to provide an outside air supply and a ceiling plenum 6 for air extraction. Outside air enters a temperature controlled space 8 from the floor plenum 4 via floor outlets 10 formed in a raised floor 12. Air is circulated within the space 8 and is eventually extracted through a suspended ceiling 14 into the ceiling plenum 6 via ceiling openings 16, such as via the light fittings, as illustrated in FIG. 1.

This arrangement may not suit some projects, for example where smoke extract ductwork is required, but is intended to illustrate one exemplary configuration. Depths of 200 mm are suitable for each of the supply and extract plenums 4, 6, based on an assumed travel distance of 20 to 30 metres from the air supply in a central core of the building to the perimeter of the plenum 4, 6.

The shallow depth of the ceiling void 6 will require careful co-ordination of pipework, cables and other services. As shown, services 18 for the air conditioning unit 2 are delivered to and from the air conditioning unit 2 within the ceiling void 6. Such services 18 include cooling/heating liquid medium, e.g. chilled or heated water, power and control supplied to the air conditioning unit 2 and condensed water and return refrigerant from the air conditioning unit 2.

The air conditioning unit 2 is designed so as to achieve the same comfort quality standards as conventional air conditioning systems, e.g. fan coil units, chilled beams, chilled ceilings, VAV boxes, etc., whilst being only 200 mm high. It could save typically 300 mm on each storey height of a building. For a building where the height is limited to 45 metres (approximately 12 stories at 3.7 m floor to floor height), this would add one floor within the same overall building height.

Furthermore, the air conditioning unit 2 does not require an accessible ceiling and can instead fit in the narrow 200 mm ceiling void 6 discussed above. Also, compared with a conventional fan coil system there is no secondary ductwork, and potentially far less primary ductwork.

As will be discussed below, the ductwork and pipework for the air conditioning unit 2 can be installed as part of first fix, and then a main body 3 of the air conditioning unit 2 including the fan 28 and coils 26 can be installed during a second fix, before or after the suspended ceiling 14 is installed. Commissioning, maintenance, and even unit replacement can be carried out after the ceiling 14 is installed.

Figure 2:
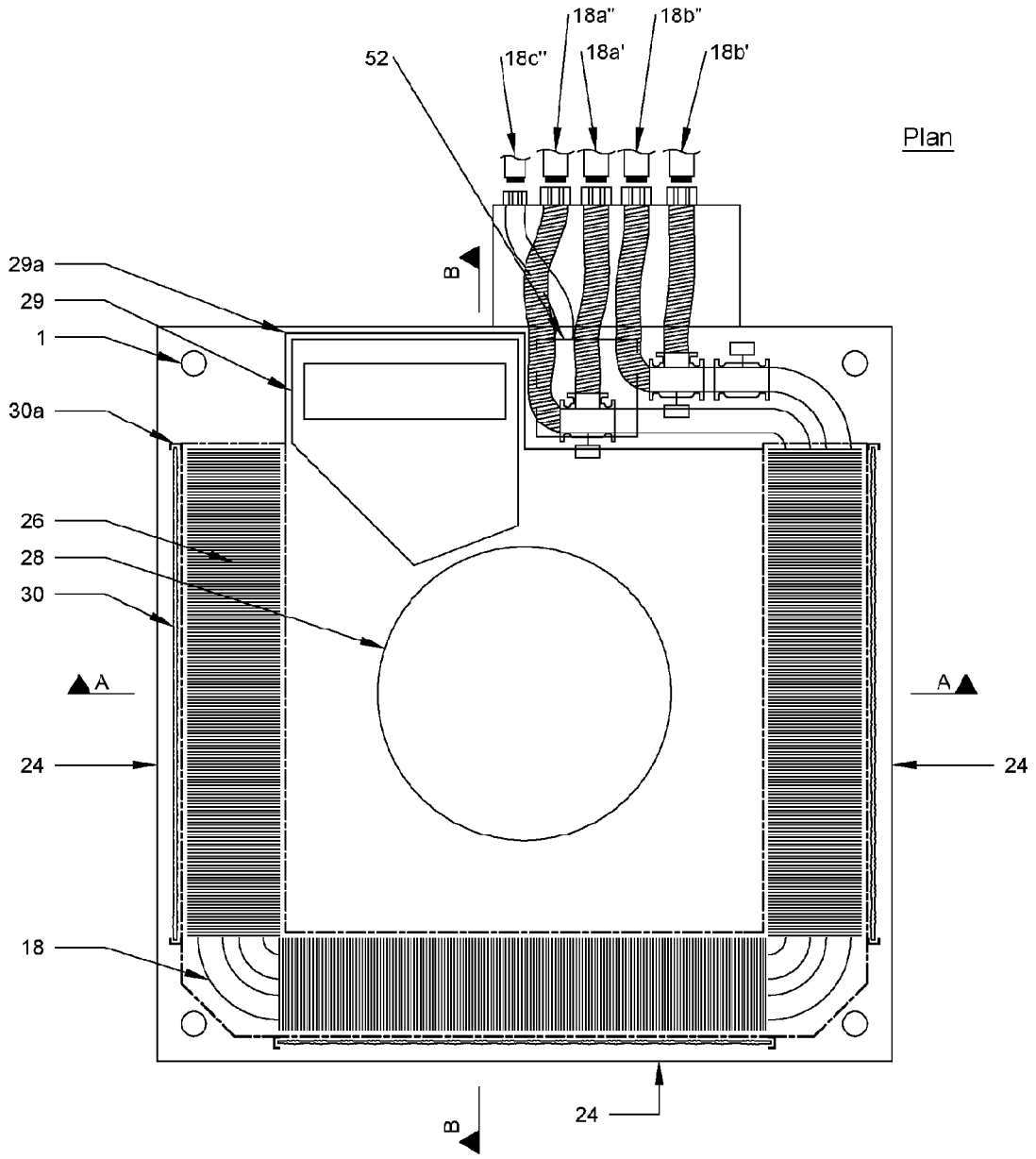
FIG. 2 shows a sectional plan view of a main body of the air conditioning unit of FIG. 1.
Figure 3A:
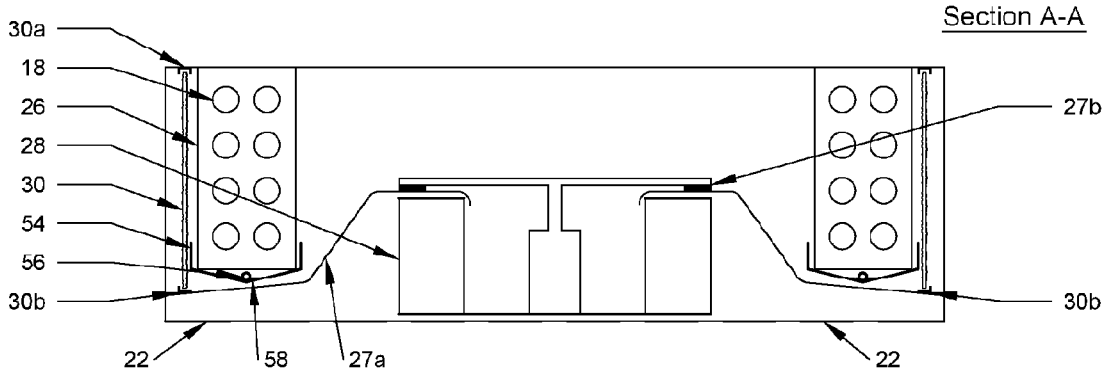
FIGS. 3A and 3B show cross sections of the main body of the air conditioning unit of FIG. 1, taken along section lines A-A and B-B in FIG. 2, respectively.
Figure 3B:
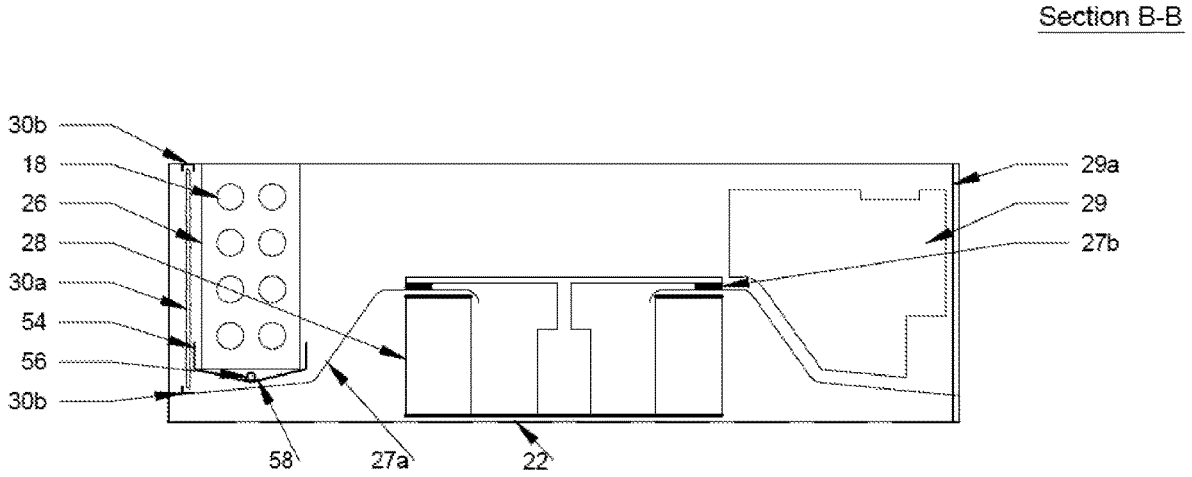

FIG. 2 shows a sectional plan view, of a main body 3 of the air conditioning unit 2 shown in FIG. 1. FIGS. 3A and 3B show cross-sectional views of the main body 3 taken along section lines A-A and B-B.

The air conditioning unit 2 is defined by a main body 3 having a front face, a rear face, and four side faces. The front and rear faces of the main body 3 are generally parallel to one another and the side faces are generally perpendicular to the front and rear faces. Suitable fixing means 1, which may comprise threaded rods, are preferably provided for suitably installing the air conditioning unit 2. When installed, the front face is exposed to the temperature controlled space 8.

The front face is substantially square having dimensions of about 600 mm×600 mm, which is sized to fit a standard ceiling grid (although other shapes and/or dimensions could of course be utilised). The unit has a height of about 200 mm between the front and rear faces.

The front face comprises a facia plate 20 having air outlets 22 through which conditioned air is directly injected into the temperature controlled space 8, i.e. there is no secondary ductwork. The air outlets 22 may comprise perforations in the facia plate and, at the outlets 22, the facia plate 20 is preferably at least 50% perforated. The side faces comprise air inlets 24 through which air is drawn into the air conditioning unit 2. The air inlets 24 are not usually visible during normal operation and so may simply comprise openings, but a filter 30 or the like may also be used to prevent large debris entering the unit 2, if desired.

Between the air inlets 24 and the air outlets 22 there is an airflow passage through which the air flows and is conditioned. In this arrangement, the airflow passage is defined by a fan plate 27*a* separating the air flowing into the fan 28 from the air being output by the fan 28.

Within the main body 3 is provided one or more thermal element 26 to heat and/or cool the air in the airflow passage and a fan 28 to drive the air. The thermal elements 26 are provided upstream of the fan 28. Also within the main body 3 may be provided a plurality of air filters 30. The air filters 30 are disposed upstream of the thermal element 28. An air filter 30 and a thermal element 26 are provided adjacent to each air inlet 24. The air filters 30 are preferably retained by respective air filter guides 30*a* at their upper and side edges. The air filters 30 are retained in position by a clip at their lower edge.

The air inlets 24 are provided on three of the four sides of the air conditioning unit 2. It is desirable to maximise the air inlet area so as to minimise the airflow velocity over the thermal elements 26. However, some space must be left for the services 18 to enter the unit. Thus, it is not possible for the inlets 24 to cover more than about three and a half of the sides (less than about 90% of the periphery of the air conditioner unit 2). However, the air conditioner unit 2 would of course still operate with a smaller number of inlets 24, for example air inlets 24 could be provided on only two sides, i.e. along at least 50% of the periphery of the air conditioner unit 2.

A baffle plate 29*a* is provided on the fourth face of the air conditioner unit, which wraps round the fan control unit 29 and condensate pump 52, and prevents air from being drawn in, which would bypass the thermal elements 26.

By providing the air inlets 24 about the periphery of the air conditioner unit 2, the inlet area can be maximised. In this air conditioning unit 2, the air travelling across the thermal element 26 travels at approximately 0.6 to 1.0 metre/second, which is significantly lower than in conventional fan coil units, where there air speed at the thermal element 26 is about 2.5 metres/second. This improves heat transfer to or from thermal element 26 and reduces the pressure drop across the thermal element 26, allowing a smaller fan 28 to be used and hence allowing the air conditioner unit 2 to be made thinner than traditional fan coil units where the air would be drawn in at the centre at relatively high speed.

During operation, air enters the air conditioner 2 substantially horizontally through the air inlets 24 into the airflow passage. The air continues substantially horizontally through one of the air filters 30 and across a region of the thermal element 26. The air is then drawn vertically downwards into the fan 28 and ejected directly out of the air conditioning unit 2 via the air outlets 22 into the temperature controlled space 8.

The air conditioning unit 2 may include turning vanes (not shown) on the approach to the fan 28 to smooth the airstream and reduce friction. The arrangement shown in FIG. 2 is equivalent to a 90 degree bend via a plenum. Installing turning vanes in this location may reduce the pressure drop for this bend to 50% of the pressure drop for a plenum arrangement (i.e. without any turning vanes).

The fan 28 is a plug fan, which has the known characteristic of having lower pressure drops and noise than the tangential fans normally used in fan coil units. The fan is driven by a motor (not shown), which may be a DC motor to give good energy performance and variable speed capabilities.

The blades of the fan 28 are arranged so as to direct the air ejected from the outlets in a pattern that spreads out in a circular flow. The blades may include a ramp just before discharge to increase the downward velocity of the air to achieve the desired air pattern.

To illustrate the efficiency of this configuration, one exemplary and non-limiting specific example will now be described. Based on a selection of 0.23 $m^3/s$ at 25 Pa, 70% fan efficiency and 90% motor efficiency, the fan power consumption will be about 9 W. Serving a floor area of 25 $m^2$, this is a fan energy consumption of 0.36 $W/m^2$. This is much lower than the usual "rule of thumb" concept design stage allowance of 5 $W/m^2$ for fan coil unit fan energy.

In the UK Building Regulations Part L there is a requirement to achieve a minimum Specific Fan Power (SFP) calculated as power (watts) per unit flow rate of air (litre/second). For fan coil units and other terminal units the required SFP inferred from the Part L energy calculation is 0.3 or lower. Using the figures above the SFP is 0.039. This is again far better than the requirement.

In an alternate arrangement, a mixed flow fan may be used, i.e. having curved blades in the centre, changing to vertical blades at the perimeter. Such a fan may also satisfy the conditions of low noise and low energy consumption, whilst fitting into a narrow air conditioning unit 2, e.g. having a height of 200 mm.

The blades of the fan 28 are designed so that the air conditioning unit 2 will provide a swirling air flow pattern, similar to a swirl diffuser. The air discharges straight from the tips of the fan blades in a pattern that spreads out in a circular flow. This means that for minimal change of direction, and therefore minimal energy loss, a high induction air flow can be achieved.

It is desirable to minimise vibration from the fan 28 within the air conditioning unit 2 to minimise noise. This can be achieved by using high quality, well balanced fan 28, and by the use of anti-vibration mounts 27*b* at the points where the fan is supported. For example, the fan 28 is supported by the fan plate 27 and is connected via anti-vibration mounts 27*b*.

The front face of the air conditioning unit 2 comprises a perforated facia plate 20, with at least 50% opening at the outlets 22. This is sufficient for the air to pass through without altering the air flow characteristics.

As the air flow pattern from the fan 28 does not depend on the coanda effect from the adjacent ceiling, the air conditioning unit 2 can be pendant mounted (as will be discussed below) and will have the same air flow pattern as the unit 2 mounted in the ceiling. This fan arrangement also means that the air flow can be reduced to almost zero without cold air dumping. Cold air dumping is the phenomenon whereby a current of cold air, typically flowing horizontally below a ceiling and adhering to the ceiling due to the coanda effect, becomes detached from the ceiling, thereby falling down into the occupied space (dumping) with a consequent risk of cold draughts.

The air conditioning unit further includes air inlets 24 defined around the sides of the main body 3.

As discussed above, the thermal elements 26 are provided along three peripheral sides of the air conditioning unit 2. In this air conditioning unit 2, the thermal elements 26 comprise thermal coils 26*b* and heat exchange fins 26*a* for maximising thermal transfer. The coils 26*b* receive heated or chilled water via inlet pipe(s) 18*a*, which is then pumped through the coils 26*a* before being returned via the return pipe(s) 18*b* to be regenerated. The condensate pump 52 may be located below or adjacent to the changeover and control valves, 32*a* and 32*b*, and pumps condensed water into the condensate return pipework 18*c*".

Figure 4:
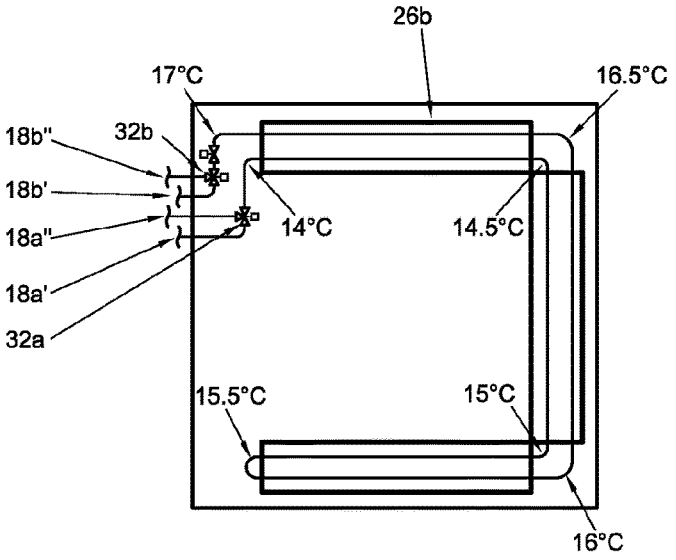
FIG. 4 shows a schematic plan view of the thermal coils of the air conditioning unit of FIG. 1.
Figure 5:
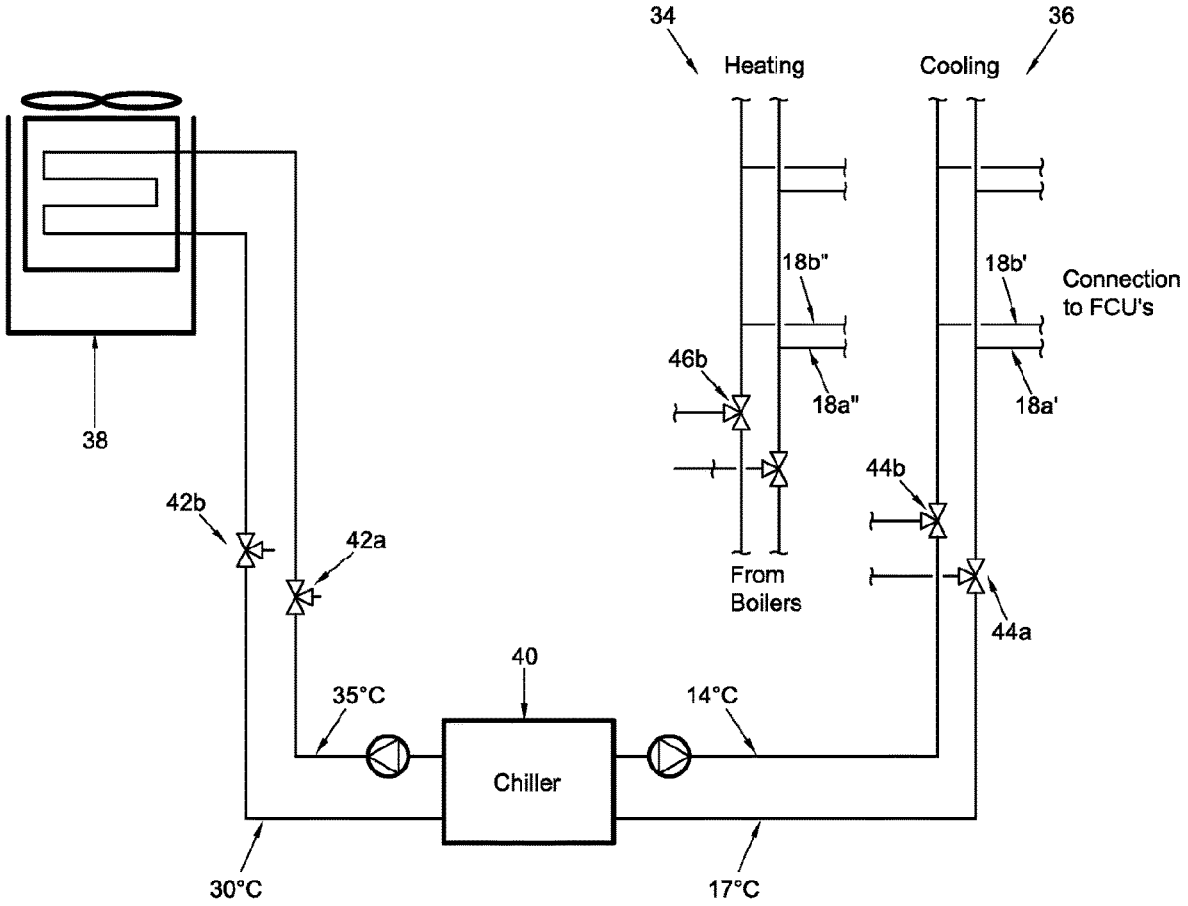
FIG. 5 shows a primary piping arrangement for supplying the cooling or heating liquid medium to the air conditioning unit of FIG. 1.

FIGS. 4 and 5 show schematically the thermal coil 26*b* and the corresponding HVAC infrastructure, respectively. The present air conditioning unit 2 uses a single coil 26*b*, having valves 32*a*, 32*b* to provide a changeover from the heating pipes 18*a*", 18*b*" to the cooling pipes 18*a*', 18*b*', as required. Whilst this adds complexity to the circuit, it reduces the energy loss when driving air through the coil 26*b*.

FIG. 4 shows a cooling arrangement where cool water is supplied via the cold inlet pipe 18*a*'. In order to maximise the heat transfer in the coil 26*b*, a counterflow heat exchanger arrangement is used. One exemplary and non-limiting specific example will now be described—the flow water at 14° C. enters the downstream set of pipework, passes horizontally through the coils, heating up to 15.5° C., then returns via the upstream set of pipework, and returns to the cold return pipe 18*b*' at 17° C. In the cooling mode (as illustrated in FIG. 4), a counterflow heat exchange configuration means that the coldest water (from the inlet pipe 18*a*') is adjacent to the air leaving the cooling coil 26*b* (radially inner side), and the warmer water (to the return pipe 18*b*') is adjacent to the air entering the cooling coil 26*b* (radially outer side). This gives the most efficient use of the heat exchange process, and gives the lowest possible air conditioner output temperature.

In an alternative arrangement, the changeover valves 32*a*, 32*b* and the heating medium inlet and return pipes 18*a*", 18*b*" may be omitted such that the coil 26*b* provides a cooling-only coil 26. In such an arrangement, separate heating units may be provided at the perimeter of the building for heating when necessary.

In a further alternative arrangement, a separate heating coil may be provided adjacent to a cooling-only coil 26*b*. This is the same configuration as a conventional cooling and heating ('4-pipe') fan coil unit. However, this has the disadvantage of increasing the coil pressure drop, and thereby increasing energy use and decreasing the overall air conditioning unit efficiency.

The present arrangement is a two-row coil 26*b*, split into three sections on each of three sides of the air conditioning unit 2. This is merely exemplary and other numbers of section and/or rows could be used, for example air inlets 24 and corresponding sections of the coil 26*a* may be provided only on two sides. Also one-row or three-row coils 26*a* may be appropriate depending on the duty.

FIG. 5 shows an HVAC infrastructure for supplying cooling or heating medium to a plurality of air conditioning units 2. Within the infrastructure, the cooling system 36 for the air conditioning unit 2 is generally independent from the heating system 34. First the cooling system 36 will be described.

The cooling system 36 comprises a condenser 38, such as a cooling tower, and a chiller 40. The cooling medium (e.g. water) for the air conditioning units 2 is cooled by the chiller 40 and the heat is dissipated by the condenser 38.

Conventional fan coil operating temperatures are in the region of about 6° C. flow and about 10 to 12° C. return. However, these temperatures will give rise to condensation under the majority of room conditions, and a condensate removal system must therefore be included.

An alternative approach is to use higher water temperatures, typically 10 to 12° C. flow and 14 to 16° C. return, in order to avoid condensation. These temperatures will not give rise to condensation under the majority of room conditions (although a condensate removal system is typically still included).

The present air conditioning unit 2 has been selected to have the option to run using low energy sources which are non-refrigerated, with temperatures of 14° C. flow and 17° C. return, though other operational temperatures could be used.

During one mode of operation, the cooling medium is cooled to flow temperature using the chiller 40. In another mode of operation, water from the condenser 38 (the cooling tower) can be used directly as a refrigerated source. In the UK it is possible to run such an arrangement for a significant portion of the year using the condenser water from the cooling tower 38 for cooling directly. To deliver a design flow temperature of 14° C. directly from a cooling tower, the ambient wet bulb temperature would have to be 11° C. or lower, based on a tower size, to give a 3° C. difference between the wet bulb and the flow temperature. In London, for example, ambient wet bulb temperatures are below 11° C. at least 50% of the hours in the year.

Thus, in the winter, the water from the cooling tower 38 could be connected directly to the air conditioning unit 2 by connecting cooling tower flow and return valves 42*a*, 42*b* to respective cooling circuit system flow and return valves 44*a*, 44*b*. In the summer, the cooling tower 38 would connect to the chiller 40, with condenser water temperatures of, for example, 30° C. flow and 35° C. return. The chiller 40 would generate chilled water at the desired temperatures.

Other sources of low energy cooling water may also be used, for example the cooling tower 40 may be replaced or supplemented by using, for example, river water and/or ground water.

If a water-cooled chiller 40 is used for the cooling options, at high ambient temperatures, e.g. operating at temperatures of 35° C./30° C., the refrigeration circuit can be arranged to provide condenser water from the cooling tower 38 to the heating system 34 by connecting the cooling tower flow and return valves 42*a*, 42*b* to respective heating circuit system flow and return valves 46*a*, 46*b*. This can be used for heat recovery, providing 'free' heating to the air conditioning units 2 that require heating.

As discussed above, even where relatively high operating temperatures are used to minimise condensation, it is still common to include a condensate removal system 50 (although this could be omitted if desired). Use of a condensate removal system 50 then allows the air conditioning unit 2 to be operated at lower temperatures, if desired. It also means that the unit 2 can be used in a mixed mode building, i.e. where natural ventilation is used for parts of the year. (In a fully air conditioned building with a sealed façade the humidity can be kept to a low figure, such as 40% RH, to avoid condensation. In a naturally ventilated building this is not possible, and a humidity of up to 100% RH may occur, which would cause condensation on a cold surface such as an air conditioning unit cooling coil)

Figure 6:
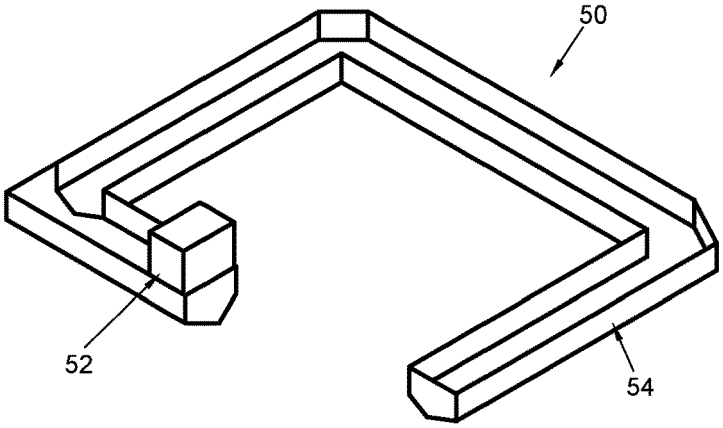
FIG. 6 shows a condensate removal system of the air conditioning unit of FIG. 1.
Figure 7:
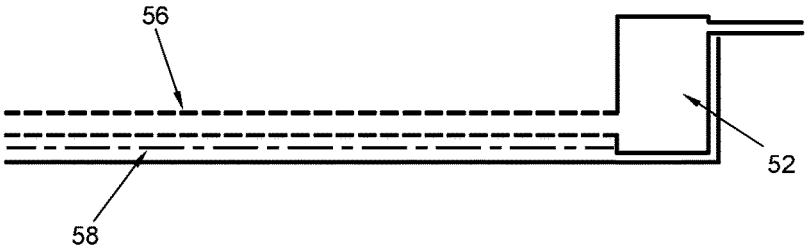
FIG. 7 shows a longitudinal section through the condensate removal system of FIG. 6.
Figure 8:
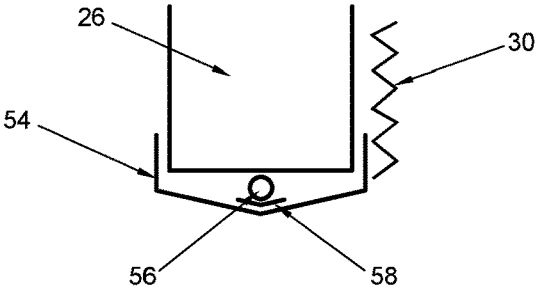
FIG. 8 shows a transverse section through the condensate removal system of FIG. 7.

FIG. 6 shows a condensate removal system 50 for the air conditioning unit 2. FIG. 7 shows a longitudinal section through the condensate removal system 50, and FIG. 8 shows a transverse section through the condensate removal system 50.

Due to the shallow depth of the air conditioning unit 2, gravity drainage may not be feasible. When gravity drainage is not possible and condensate removal is required it must be by pumping. The condensate removal system comprises a condensate pump 52 and a drip tray 54, made of for example plastic, aluminium or other suitable material, provided below one or more cool elements of the unit 2, such as portions of the cooling coil 26*b* and/or the cool water control valves 32*a*, 32*b*. The condensate pump 52 is preferably of the variable geometry type, which does not require a sump or float switch. The pump 52 will run slowly to remove condensate as it collects in the drip tray 54, in contrast to a centrifugal pump which requires a sump and only pumps the condensate after a sufficient quantity has accumulated.

A hydrophilic condensate collection member 56, for example in the form of a pipe with a hydrophilic coating, is provided, which preferably runs the length of the drip tray 54. The hydrophilic coating allows water to pass through the coating but not air. This means that the member 56 will collect condensate at any point along its length.

A moisture sensor 58, for example a moisture sensitive conductor is also provided, which also preferably runs the length of the drip tray 54. If a moisture above a threshold moisture level is detected, then the pump 52 is activated. The condensate control system 50 may also have an override to turn off the chilled water supply and fan 28 in the event that the condensate accumulates, for example if there is a fault.

By use of this condensate control system 50, all condensate is trapped by the hydrophilic member 56 and then pumped out of the air conditioning unit 2 by the pump 52.

Figure 9:
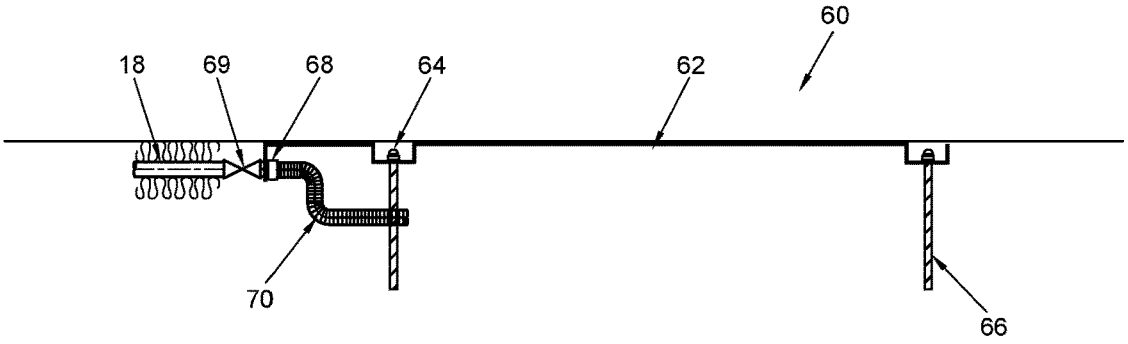
FIG. 9 shows a sectional view of an installation frame of the air conditioning unit of FIG. 1.

The air conditioning unit 2 is designed to be installed in two phases, corresponding to first fix and second fix. First, an installation frame 60 is installed at the time of first fix. The installation frame 60 is shown in section in FIG. 9 and in plan in FIG. 10. The main body 3 of the air conditioner unit 2 is then installed in second fix, shown in FIG. 11.

The installation frame 60 comprises a rigid body portion 62 adapted to be mounted to the soffit of the ceiling during a first fix. The rigid body portion 62 further comprises raised sections 64, preferably adjacent the corners of the body portion 62, adapted to receive threaded rods 66, for example via internally-threaded through holes. The threaded rods 66 provide the frame 60 with means for mounting the main body 3 of the air conditioning unit 2 to the installation frame during the second fix.

Figure 10:
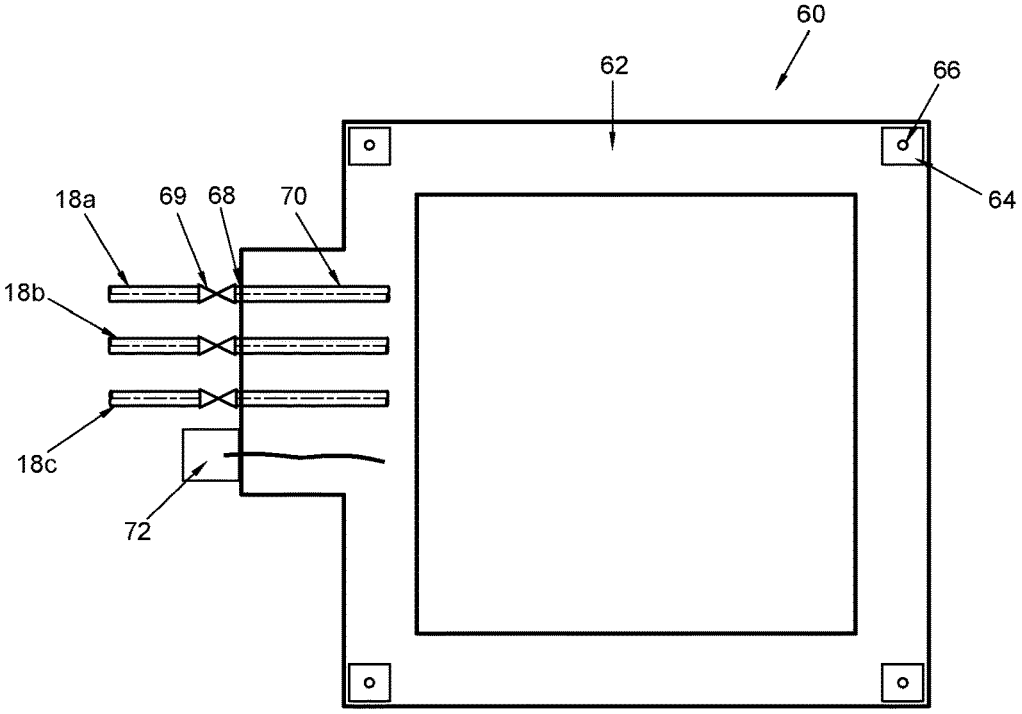
FIG. 10 shows a plan view of the installation frame of the air conditioning unit of FIG. 1.

The installation frame 60 may further comprise fluid connection points 68 for certain services 18, such as inlet and outlet cooling/heating medium pipes 18*a*, 18*b*, to be attached the installation frame 60. FIG. 10 illustrates one pair of pipes—as described before there may be two pairs if a there is a 4 pipe system. Within the installation frame 60 may also be provided flexible connections 70 for linking the fluid connection points 68 of the installation frame 60 to the main body 3 of the air conditioning unit 2, when it is installed during the second fix. The connection points 68 should each include an isolation valve 69 to allow the main body 3 of an individual air conditioning unit 2 to be removed without shutting down services to a larger network.

Similarly, the installation frame 60 may also comprise electrical connection points 72 for other services 18, such as power and control cables, to be attached to the installation frame 60. The electrical connection points 72 may each comprise a fused spur and interface box.

The flexible pipes and cables are preferably located to be sufficiently short for them to be accessed by hand from below through the main body of the air conditioning unit when it is open in 'self-access' mode.

The following sequence is recommended for installation:

First Fix

Preparation of the underside of ceiling slab (i.e. to be level, dry and clean).

Setting out the ceiling grid and components.

Fixing of the installation frame 60 to the ceiling slab (or set out correctly for false ceiling grid).

Installation of services pipework, terminating at the fluid connection points 68 on the installation frame 60.

Installation of power and controls cables, terminating at the electrical connection points 72 on the installation frame 60.

Installation of power and cabling and pipework for other services (those not for the air conditioning units 2).

Second Fix

Installation of the ceiling grid.

Installation of the lights and other major ceiling components.

Installation of the ceiling tiles.

Mounting of the main body 3 of the air conditioning unit 2 onto the installation frame 60.

There are many components in a typical false ceiling, and some require more access than others. Typically the chilled water (CHW) & low-temperature hot water (LTHW) pipework, sprinkler pipework, cable trays and cables will be installed as first fix items, and will remain relatively unchanged until there is a major fit-out. These components are unlikely to require access once they have been installed.

Figure 12:
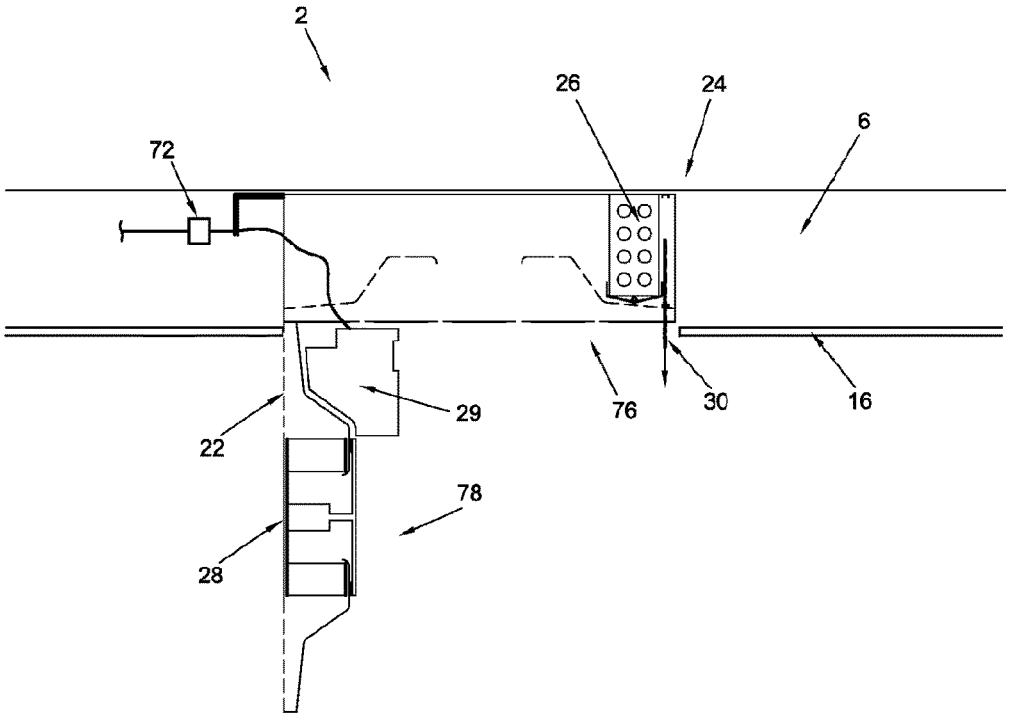
FIG. 12 shows the air conditioning unit of FIG. 1 in a maintenance position.

The components that typically do require access, either for commissioning after the ceilings are up, or later for maintenance, include lamps, smoke detectors, and the HVAC components, such as balancing dampers, balancing valves, fan coil filters and control boxes. These components are accessed in traditional installations with either access panels or a fully accessible ceiling. Conversely, the air conditioning unit 2 described herein is arranged to provide self-access, as illustrated in FIG. 12.

The main body 3 of the air conditioning unit 2 is composed of two housing portions 76, 78. The first housing portion 76 is mounted to the ceiling, for example via the installation frame 60. The second housing portion 78 is attached to the first housing portion 76 via a hinge such that it can be rotated from an operational position (as in FIG. 2) to a maintenance position (shown in FIG. 12). When moving into the maintenance position, the second housing portion 78, which includes the front face of the main body 2, swings into the thermally controlled space 8 to provide access to the components of the air conditioning unit 2.

The thermal elements 26 are mounted within the first housing portion 76. This means that the cooling/heating medium supply does not need to be disconnected when maintenance is being performed on the air conditioning unit 2.

The fan 28, fan plate 27 and motor are mounted within the second housing portion 78 such that they swing down with the second housing portion 78 when it is moved into the maintenance position. This allows a worker performing maintenance (when using a ladder) to work at eye level in front of him, rather than working on a unit 2 above his head, as has been the case with traditional fan coil units that could be maintained in situ. This working position is safer and more comfortable.

The fan 28 may include a fan control box 29, which is also mounted on the second housing portion 78. A display of the fan control box 29 can then be arranged to be easily read by the worker doing the maintenance or commissioning. Again, this can be read easily at eye level, rather than requiring the worker to look upwards when working.

In the maintenance position, the various motorized valves (such as changeover valves 32*a*, 32*b* and isolating valves 69) of the air conditioning unit 2 are easily accessible as the fan has been moved out of the way with the second housing portion 78. The condensate pump 52 and drip tray 54, which are also mounted to the first housing portion 76, are similarly easily accessible.

The filters 30 are positioned such that they can slide vertically downwards for cleaning or changing in the maintenance position.

Figure 11:
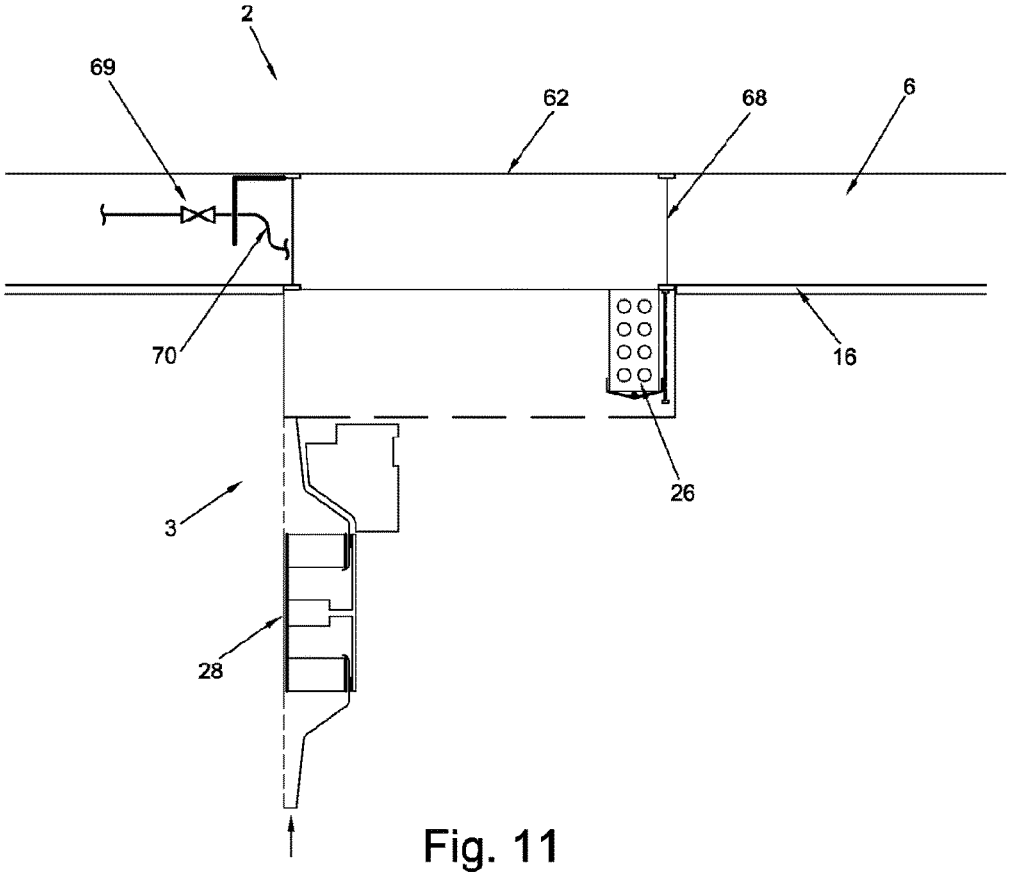
FIG. 11 shows the air conditioning unit of FIG. 1 being installed into a ceiling.

As illustrated in FIG. 11, the air conditioning unit 2 can be disconnected and dropped out of the ceiling if required. To do this, the second housing portion 78 is swung down into the maintenance position, the connections to power, cooling/heating medium and condensate are isolated (via valves 69) and the flexible connections 70 disconnected, and the four corner fixing bolts 68 are unscrewed from the first housing portion 76 to disconnect it from the installation frame 60. The whole air conditioning unit 2 can then be carefully dropped out of the ceiling.

Figure 13:
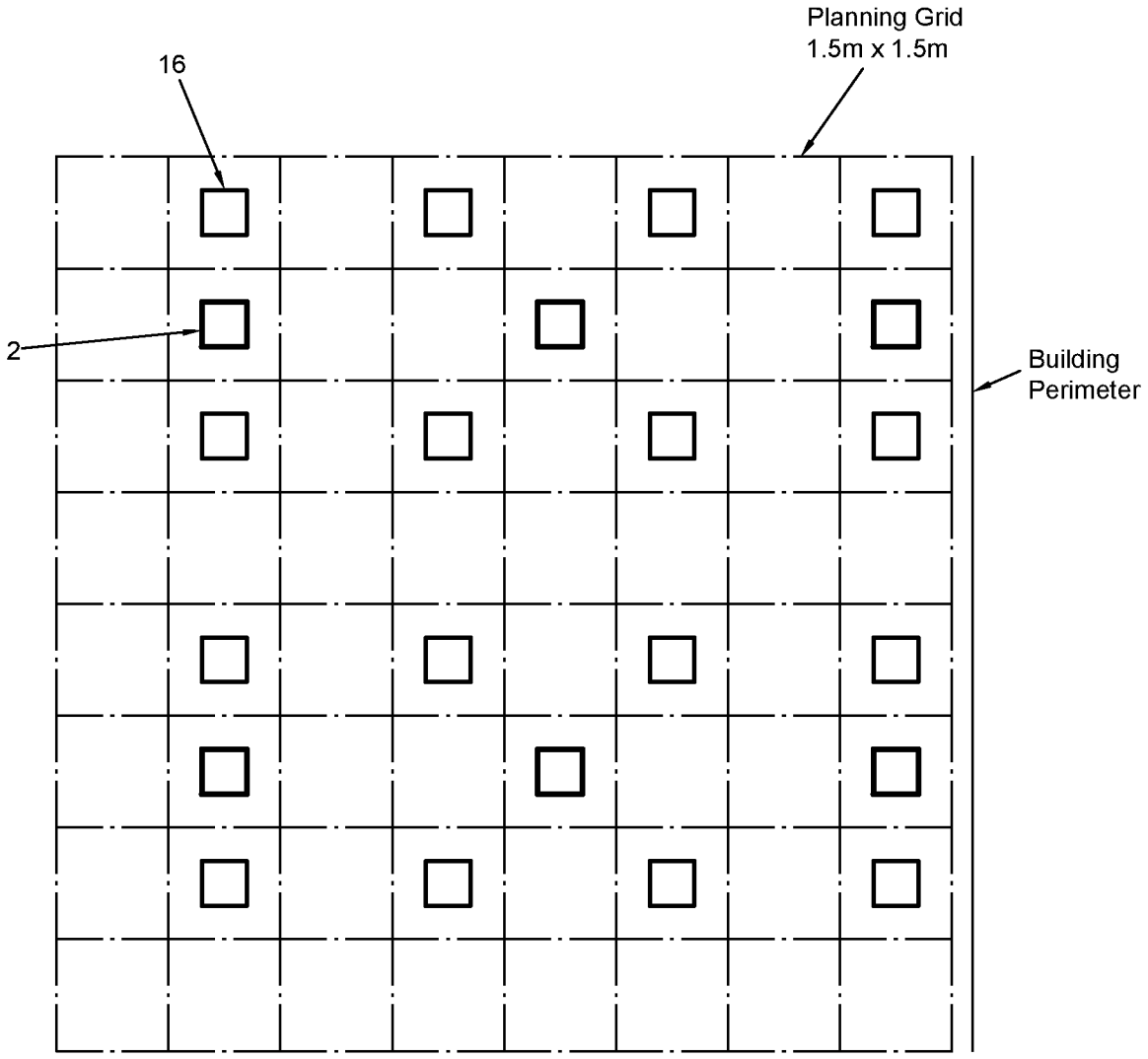
FIGS. 13 and 14 show exemplary ceiling layouts incorporating the air conditioning unit of FIG. 1.
Figure 14:
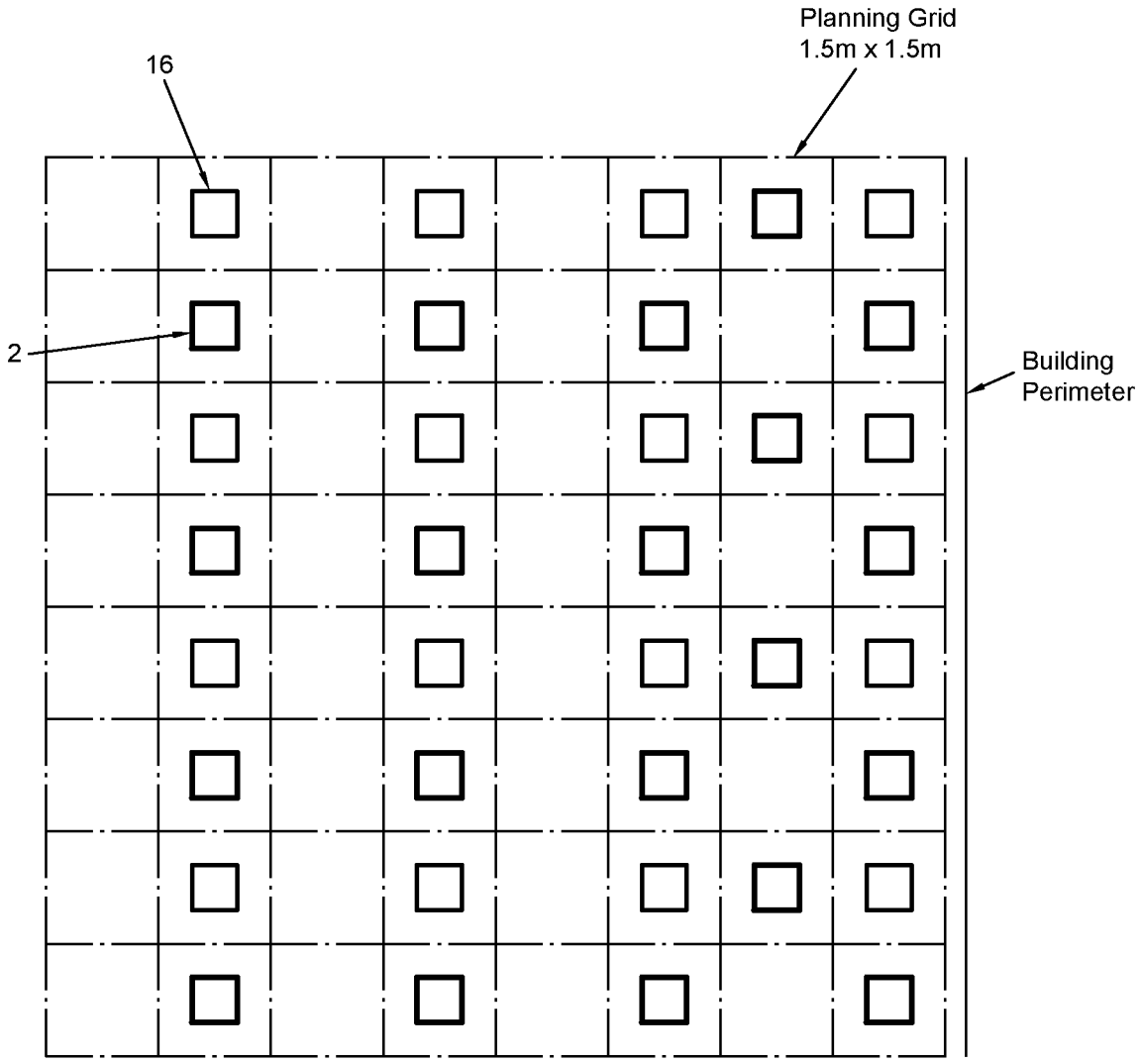

FIGS. 13 and 14 show exemplary ceiling layouts incorporating the air conditioning unit 2.

In the FIG. 13 layout, the light fixtures 16 are arranged to provide one light fixture 16 per 9 $m^2$ and the air conditioning units 2 are arranged to provide one air conditioning unit 2 per 24 $m^2$.

In the FIG. 14 layout, the light fixtures 16 are arranged to provide the same lighting density as in the FIG. 13 layout, but the air conditioning units 2 are arranged to provide one air conditioning unit 2 per 7.2 $m^2$. Furthermore, a greater density of air conditioning units 2 is provided at the periphery of the building (right-hand side of FIG. 14) to account for fabric load (external conditions).

FIGS. 15 to 25 illustrate various alternative arrangements of the air conditioning unit 2 discussed above with reference to FIGS. 1 to 14. Except for the differences discussed below, the configurations of the following alternative air conditioning units are the same as in the air conditioning unit 2 discussed above.

Figure 15:
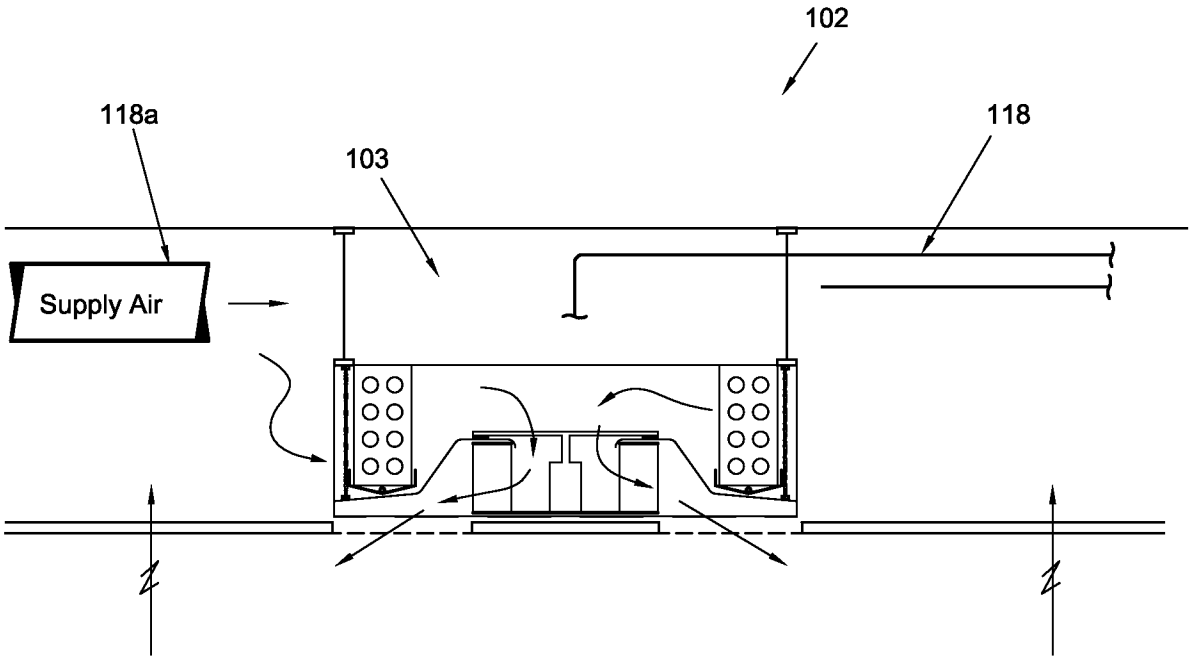
FIG. 15 shows a sectional view of an alternative air conditioning unit.

FIG. 15 shows an air conditioning unit 102 in which the main body 103 of the air conditioning unit 102 is the same as the main body 3 of the first air conditioning unit 2 shown in FIGS. 1 to 14.

In FIG. 15, the air conditioning unit 102 has been installed in a ceiling having a more conventional ceiling depth of around 500 mm. The main advantage of this is that it permits the use of a ducted outside air supply 118*a*, rather than using a plenum floor supply 4 as used by the air conditioning unit 2 shown in FIGS. 1 to 14.

Figure 16:
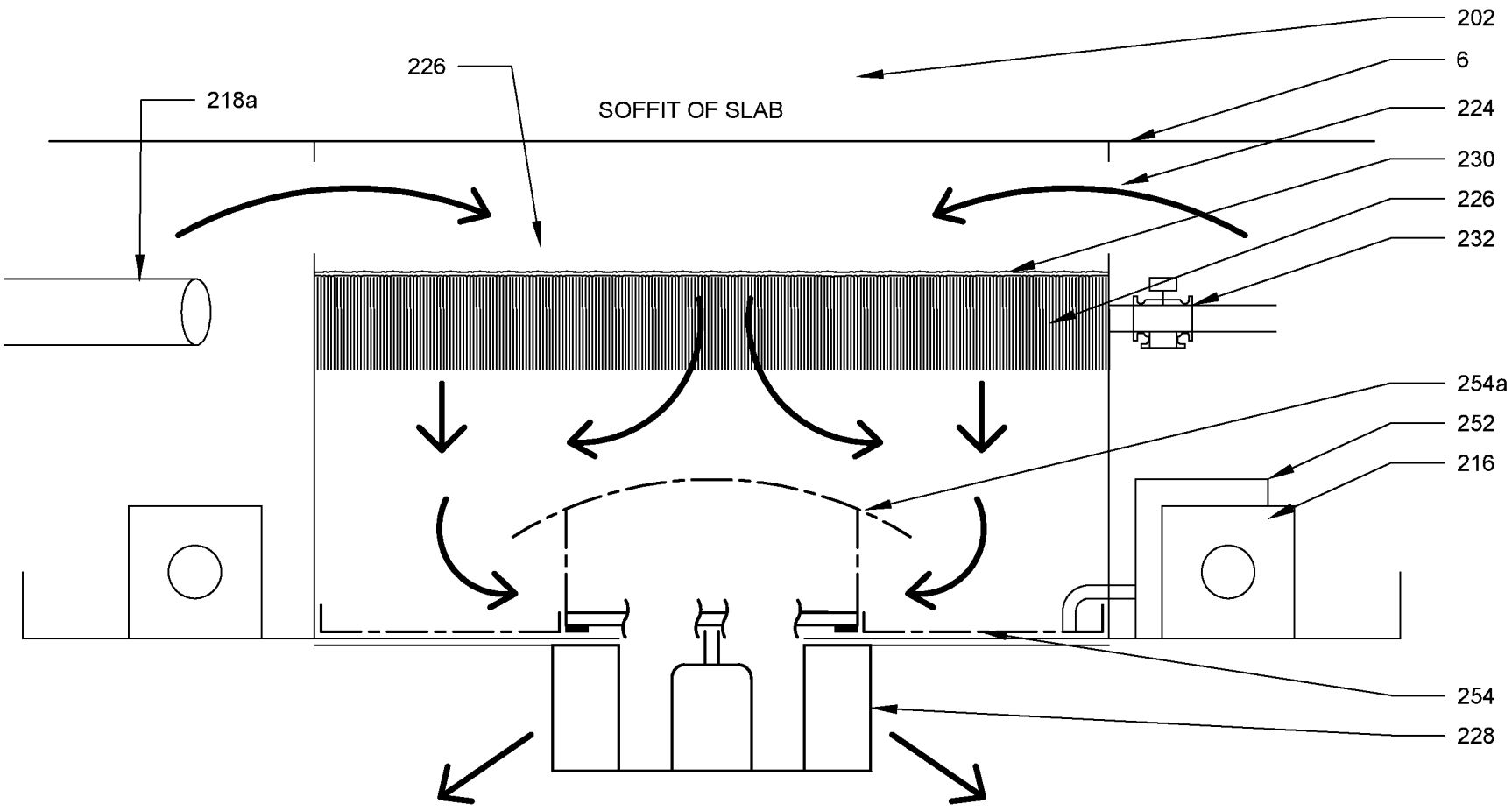
FIG. 16 shows a sectional view of another alternative air conditioning unit.

FIG. 16 shows an air conditioning unit 202 in which the thermal element 226 comprises a chilled beam 226. The use of a chilled beam 226 provides a very large area thermal element. This increases thermal conduction between the airflow and the thermal element 226, as well as reducing the pressure drop across the thermal element 226.

Whilst this configuration requires a thicker unit 202, as in FIG. 15, this then permits the use of a ducted outside air supply 218*a*.

In this arrangement, the air inlets 224 are still arranged at the side faces of the air conditioning unit 202, about its periphery. The air is drawn into the air conditioning unit 202 horizontally via the air inlets 224, and then drawn vertically downwards through an air filter 230 and then through the chilled beam 226 by the fan 228. It is then output by the fan 228 in a swirl pattern into the temperature controlled space 8.

Where a chilled beam 226 is used instead of a cooling coil 26*b*, certain modification may be made to the condensate removal system. In this air conditioning unit 202, a condensate shield 254*a* is provided above the fan 228 to prevent condensate falling into the fan 228. A condensate tray 254 is arranged vertically below the chilled beam 226, i.e. across the rear of the front face, to collect condensate from the chilled beam 226. The condensate shield 254*a* is arranged to direct condensate that would fall into the fan 228 into the condensate tray 254.

As above, a hydrophilic member is provided within the condensate tray 254 to collect the condensate, and a condensate pump 252 is used to draw the condensate along the hydrophilic member and out of the air conditioning unit 202.

Figure 17:
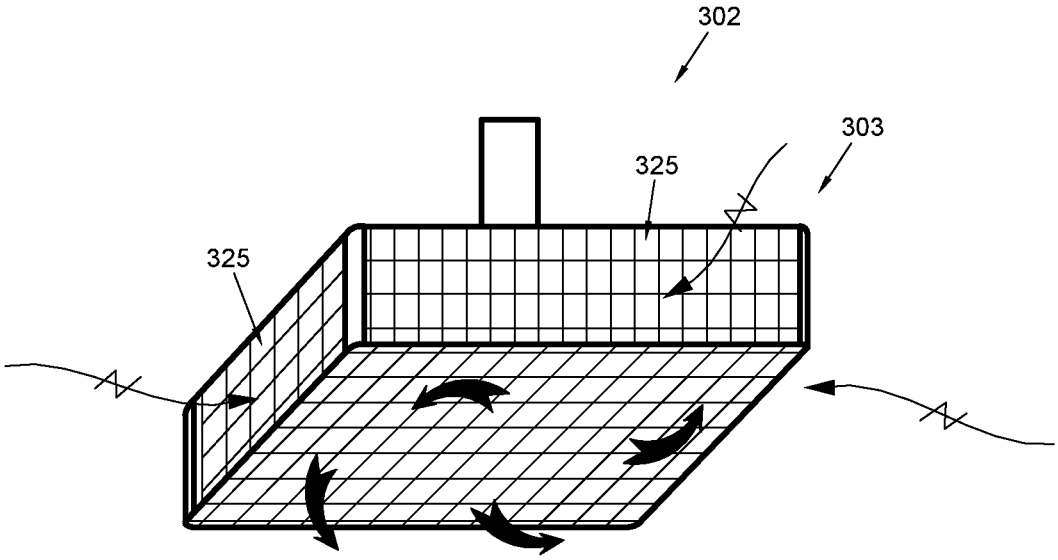
FIG. 17 shows a sectional view of a further air conditioning unit.

FIG. 17 shows pendant suspension configuration, in which a main body 303 of an air conditioning unit 302 is suspended from the ceiling. This may be appropriate for retail use, or restaurants, with exposed ceilings. There is also a move in office design towards removing suspended ceilings and having exposed services and suspended units.

In this configuration, the side faces of the main body 303 comprise perforated facia panels 325, which may be hinged to permit access to the filters around the periphery of the front face of the main body 303.

The internal structure of the main body 303 of the air conditioning unit is unchanged from that of the main body 3 of the air conditioning unit 2 shown in FIGS. 1 to 14. Particularly, as discussed above, the air discharges straight from the tips of the fan blades in a pattern that spreads out in a circular flow. As the air flow pattern does not depend on the coanda effect from the adjacent ceiling, the air conditioning unit 302 can be pendant mounted whilst still achieving the same air flow pattern as the unit 2 mounted in the ceiling.

Figure 18:
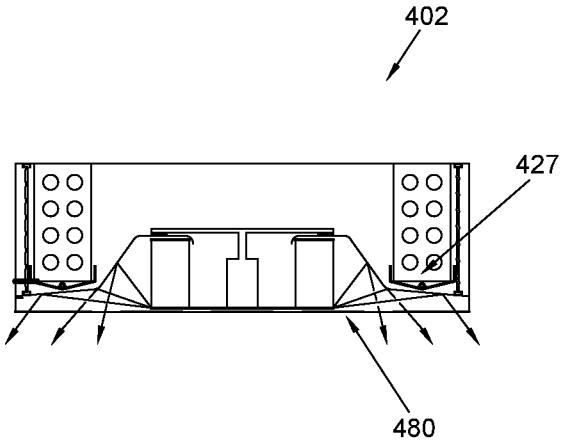
FIG. 18 shows a sectional view of a still further alternative air conditioning unit.

FIG. 18 illustrates a modification that can be incorporated into any of the air conditioning units discussed herein.

In this arrangement, the inclined surface of the fan plate 427 is used as a diffuser to bounce the intense light from LED sources 480, to produce a diffuse lighting effect in the space below. The perforated plate 22 covering the complete underside of the air conditioning unit is not present in this arrangement—the plate is solid, and reduced in width to the minimum needed to cover the fan and support the LED sources 480. An advantage of integral lighting when applied to an exposed pendant version of the air conditioning unit 302 is that the unit 302 may be perceived as a light fitting, rather than as an unlit suspended shape.

Figure 19:
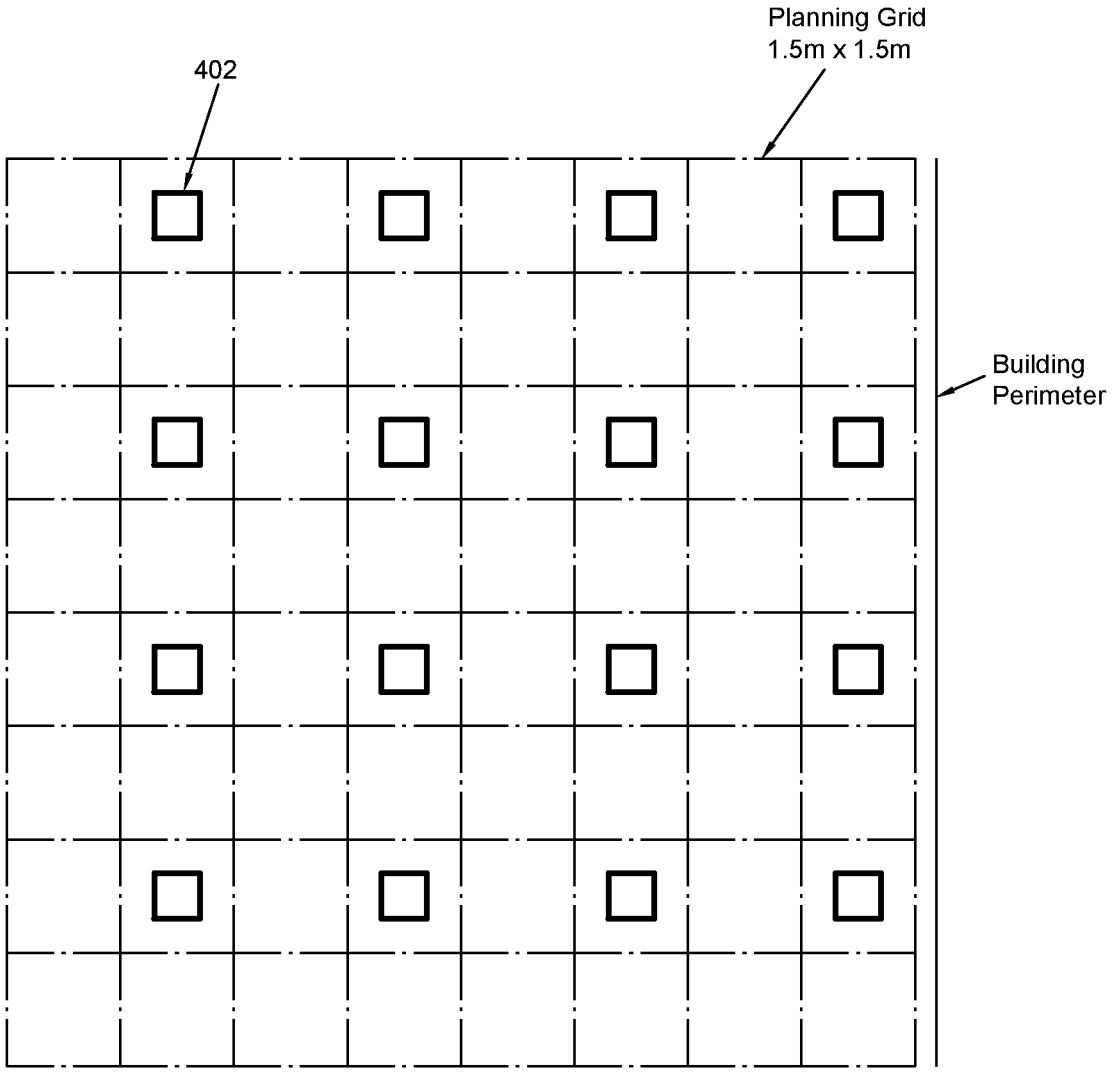
FIG. 19 shows an exemplary ceiling layout incorporating the air conditioning unit of FIG. 18.

FIG. 19 show a further exemplary ceiling layout incorporating this air conditioning unit 402. In order to provide the desired lighting density, one air conditioning unit 402 per 9 $m^2$ is provided. However, this is not visually obtrusive as the air conditioning units 402 is not perceived as such.

Figure 20:
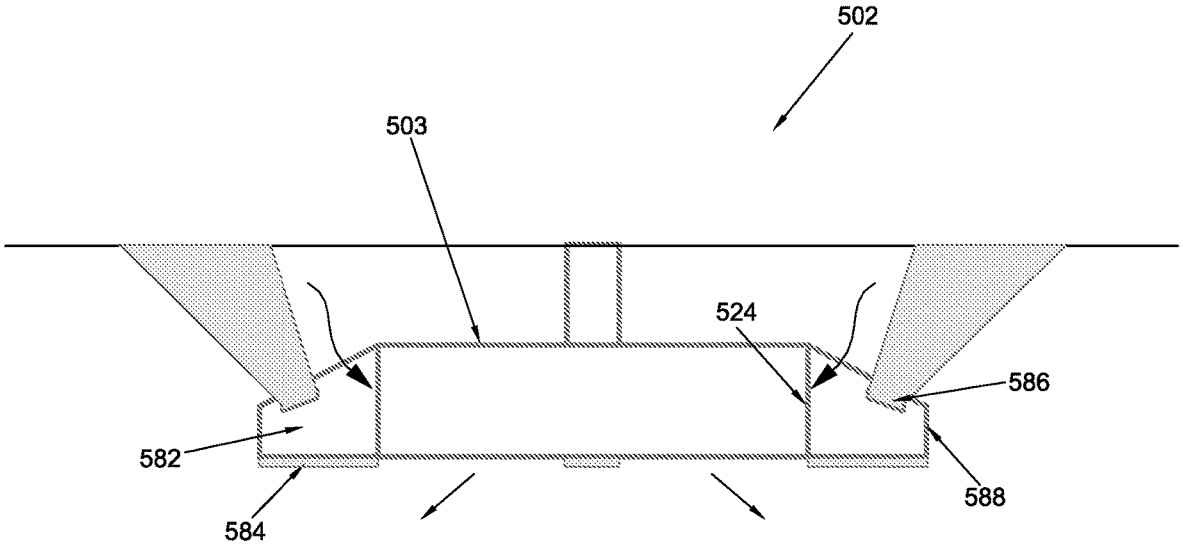
FIG. 20 shows a sectional view of another air conditioning unit.
Figure 21:
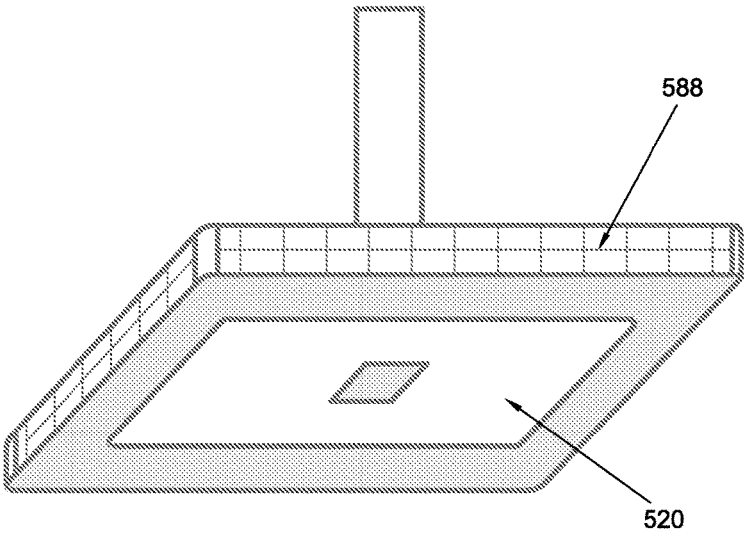
FIG. 21 shows a perspective view of the air conditioning unit of FIG. 20.

FIGS. 20 and 21 illustrate an air conditioning unit 502 which is a variation of the pendant air conditioning unit 302 shown in FIG. 17.

The main body 503 of the air conditioning unit 502 is suspended from the ceiling. The air conditioning unit 502 further comprises a rim member 582. The rim member may comprise downward-directed lights 584 and/or upward-directed lights 586.

The air conditioning unit 502 is arranged to be visually appealing by having a relatively wide unit 502 with a slim profile. The intention is for the visible depth, i.e. the height of side panels 588 of the rim member 582, to be about 10% of the width of the air conditioning unit 502. As can be seen in FIG. 20, the rear face of the rim member 582 is sloped such that the sloping back panels will be hard to see from below. In this example, the side panels 588 of the rim member 582 have a height of about 100 mm and the rim member 582 has a width of 200 mm. This results in an air conditioning unit 502 having apparent dimensions of about 1000 mm×1000 mm×100 mm.

The side panels 588 and facia plate 520 preferably have a high quality finish, such as stainless steel. To provide a "clean" appearance, the back panels of the rim member 582 may comprise perforated air inlets 590 to allow air to be drawn in on the non-visible upper side, through the rim member 582 into the air inlets 524 of the main body 503.

Figure 22:
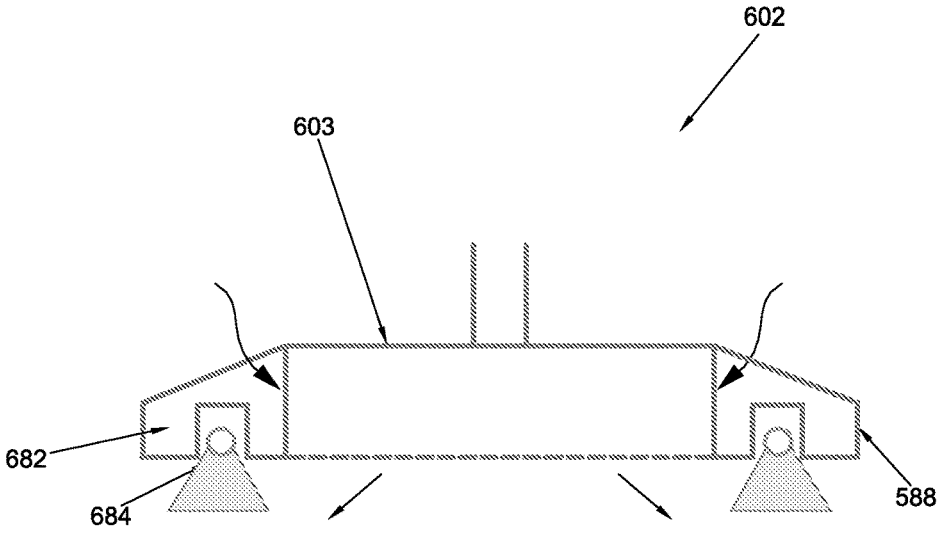
FIG. 22 shows a sectional view of yet another air conditioning unit.
Figure 23:
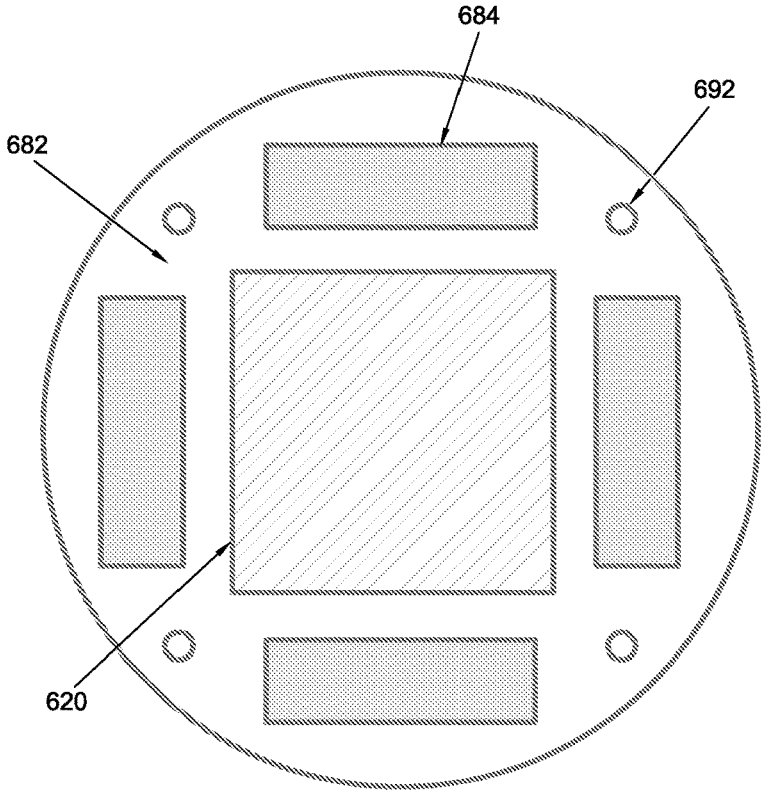
FIG. 23 shows a plan view seen from below of the air conditioning unit of FIG. 22.

FIGS. 22 and 23 illustrate a multi-service air conditioning unit 602 which is a variation of the pendant air conditioning unit 502 shown in FIGS. 20 and 21.

There has been a trend to use multi-service units 602 in offices, incorporating all of the MEP components required in a single unit. The multi-service air conditioning unit 602 has a rim member 682 that provides lighting 684, as well as various other services 692, such as smoke or heat detectors, sprinklers, public announcement/voice alarm loudspeakers, and/or PIR detectors.

FIGS. 24A to C show a vertical air conditioning unit. The air conditioning unit is the same as the air conditioning unit 2 shown in FIGS. 1 to 4, except that the condensate removal system 50 is modified so as to provide a drip tray spaced vertically below the thermal elements and a coil provided at an oblique angle.

The coils 26 are again provided on three sides. They are arranged so that condensate can be collected from each of the three coils. The top side of the unit contains the fan controls, the control valves and the condensate pump. There may be provided an upper small drip tray below this section, with a branch of the hydrophilic drain pipe.

The two side coils 26, which extend substantially vertically, have the same size and duty as in the air conditioning unit 2 shown in FIGS. 1 to 4. The lowest of the three coils, which extends substantially horizontally, is, in contrast, smaller in length and height, and is fitted at an angle of approximately 30 degrees from the vertical, as seen most clearly in FIG. 24B. The air flow enters the lower surface of the air conditioning unit across the whole width of the filter 30, which permits the pressure drop to remain low. The air passes to the side of the drip tray below the coil, through the coil and then up into the unit, as indicated by the arrows in FIG. 24B. The coil is angled at approximately 30 degrees from the vertical to permit the air to flow at an angle into the unit, in a region that is not covered by the drip tray. As seen in FIG. 24C, the drip tray 54, which is substantially planar (except for vertically projecting side walls) has an elongated central portion that extends across the entire width of the angled coil 26 and end portions that project from the ends of the central portion to lie entirely under the vertically extending side coils 26. Any condensate that forms on the face of the angled coil 26 will run down the face of the angled coil into the drip tray, to be caught by the central portion thereof. Any condensate that forms on the face of the vertically extending side coils will be collected by the end portions. Whilst, an angle of 30 degrees is stated here for the angled coil 26, various alternative oblique angles will provide the desired effect.

The cooling coil pipework connections between the side coils and the angled lower coil are intricate. The pipes on the upstream face in the vertically extending side coil are connected to the pipes on the upstream face in the horizontal angled coil, and then back to the upstream face on the opposite vertically extending side coil. The same applies to the downstream pipes. This keeps the pipework connection arrangement the same as shown in the arrangement of FIGS. 1 to 4.

A branch of the hydrophilic drain pipe runs down from the condensate pump at the top of the unit to remove condensate from the lower tray. In alternative arrangements, a gravity arrangement may be used to remove condensate from the two drip trays instead.

A void may be provided above, below or to the side of the unit to allow a return air path. Outside air can be ducted or supplied by a separate means.

It should be appreciated, whilst allowing for the angled coil and alternative condensate collection arrangement that any adaptations or alternatives stated in respect of the embodiments described above may be applied to the vertical arrangement described with reference to FIGS. 24A to C.

Vertical air conditioning units could be used in hotel or conference centre function rooms, in residential buildings, offices or schools. They could be located below window sills, they could further be used in underground transit stations/platforms and to cool computer rooms.

One option would be to use a 200 mm deep zone, as with the ceiling-based air conditioning unit 2. The face velocity, if based on 0.2 $m^3$/sec and a 600×600 diffuser, would be 0.55 m/s face velocity, which would be too high for some applications. However, if the depth of the unit 702 is increased to 250 to 300 mm and a diffuser plate 723 is used, then the face velocity can be reduced to 0.25 m/s. If the supply temperature was also to be set at 18° C., then the unit 702 would reproduce the supply conditions of a displacement diffuser, which is known to give acceptable comfort for occupants near the diffuser.

Figure 25:
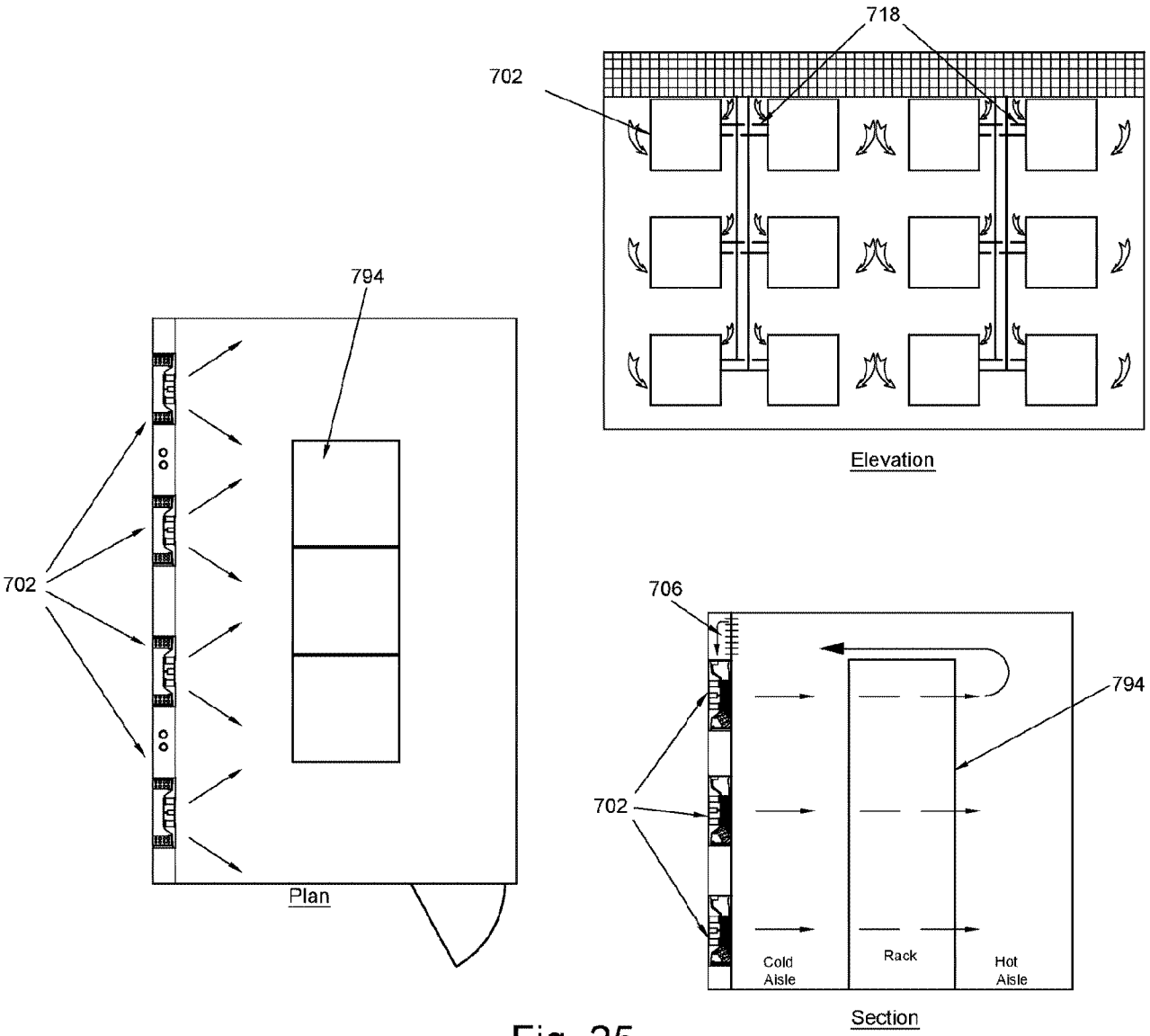
FIG. 25 shows an exemplary computer room layout incorporating the air conditioning unit of FIG. 24.

If an array of vertical air conditioning units 702 is installed in a wall it is possible to achieve the cooling loads need to cool for example a small computer room, such as an SER (Small equipment Room) or SCR (Sub Comms Room), with a single row of racks 794. This arrangement is illustrated in FIG. 25.

In the example sketched, with three computer racks 794 with a conventional cooling load of 1.5 kW each, the loads and cooling capacity will be:

Load
3 racks @ 1.5 kW=4.5 kW
Resilience required: N+1
Cooling Capacity
Cooling load: 10 units @ 1.9 kW=19 kW
Resilience: 2 units @ 1.9 kW=N+2

The cooling capacity far exceeds the requirement of standard racks, and high density racks of 6.3 kW each could be accommodated.

All of the equipment and pipework is accommodated in the cooling wall, and no pipework runs above the electoral equipment.

The invention claimed is:

1. An air conditioning unit, comprising:

a main body including an air inlet and an air outlet, the main body defining an airflow passage between the air inlet and the air outlet;

a fan disposed within the airflow passage; and a thermal element disposed within the airflow passage upstream of the fan, wherein the main body has a first face on which the air outlet is disposed, wherein the air inlet and thermal element are disposed at the periphery of the first face, wherein the fan is oriented such that the rotational axis of the fan is substantially perpendicular to the first face, wherein the first face is adapted so as to be exposed, in use, to a temperature controlled space, and wherein the blades of the fan are arranged so that the air conditioning unit provides a swirling air flow pattern with the air discharged straight from the tips of the fan blades into the temperature controlled space in a pattern that spreads out in a circular flow, wherein the thermal element is mounted to a first housing portion of the main body and the fan is mounted to a second housing portion of the main body, the second housing portion being hinged with respect to the first housing portion, wherein the second housing portion is rotatable via the hinge with respect to the first housing portion from a first position to a second position, and wherein the fan is operable for normal use in the first position and is accessible for maintenance in the second position.

2. An air conditioning unit according to claim 1, wherein the air inlet and thermal element extend along at least 50% of the periphery of the first face.

3. An air conditioning unit according to claim 1, wherein the air outlet and the airflow passage are arranged such that, in use, the airflow velocity through the airflow passage at the thermal element is less than 50% of the airflow velocity through the airflow passage at an output of the fan.

4. An air conditioning unit according to claim 1, wherein the air conditioning unit is arranged such that, when the fan is driven to give a face velocity of 0.8 metres/second at the first face, the airflow velocity through the airflow passage at the thermal element is between 0.5 and 1.5 metres/second.

5. An air conditioning unit according to claim 1, further comprising:

an installation frame adapted to be mounted to the ceiling during a first installation time period and comprising isolatable connections for services of the air conditioning unit to be connected, wherein the main body is adapted to be mounted to the installation frame during a second installation time period, and wherein the first installation time period differs from the second installation time period.

6. An air conditioning unit according to claim 1, wherein the main body of the air conditioning unit has a thickness of less than 300 mm.

7. An air conditioning unit according to claim 1, wherein the air conditioning unit is adapted to be suspended from a ceiling.

8. An air conditioning unit according to claim 7, further comprising:

a rim member surrounding the main body, the rim member having an outer edge height that is less than 60% of the thickness of the main body.

9. A structure including the air conditioning unit of claim 1, wherein the structure comprises a floor, a ceiling and a temperature controlled space defined between the floor and the ceiling, and wherein the main body of the air conditioning unit is disposed within a ceiling void of the ceiling such that the first face is exposed to the temperature controlled space.

10. A structure according to claim 9, wherein the structure is arranged such that air is supplied into the temperature controlled space via a floor void of the floor.

11. A structure including the air conditioning unit of claim 1, wherein the structure comprises a floor, a ceiling, a vertical wall and a temperature controlled space defined between the floor, the ceiling and the wall; and wherein the main body of the air conditioning unit is disposed within the vertical wall such that the first face is oriented vertically and exposed to the temperature controlled space.

12. A structure according to claim 11, wherein the vertical wall includes a void adjacent the air inlet of the air conditioning unit, the cavity being in gaseous communication with the temperature controlled space.

13. A method of installing an air conditioning unit according to claim 5, comprising:

fixing the installation frame to a ceiling;

installing ceiling services, terminating at the isolatable connections of the installation frame;

installing a suspended ceiling; and mounting the main body of the air conditioning unit onto the installation frame.

14. An air conditioning unit according to claim 1, wherein the first face comprises a perforated fascia that is configured such that air may pass through the fascia without its flow characteristics being substantially altered.

15. An air conditioning unit, comprising:

a main body including an air inlet and an air outlet, the main body defining an airflow passage between the air inlet and the air outlet;

a fan disposed within the airflow passage; and a thermal element disposed within the airflow passage upstream of the fan, wherein the main body has a first face on which the air outlet is disposed, wherein the air inlet and thermal element are disposed at the periphery of the first face, wherein the fan is oriented such that the rotational axis of the fan is substantially perpendicular to the first face, wherein the first face is adapted so as to be exposed, in use, to a temperature-controlled space, and wherein the blades of the fan are arranged so that the air conditioning unit provides a swirling air flow pattern with the air discharged straight from the tips of the fan blades into the temperature controlled space in a pattern that spreads out in a circular flow; and wherein the air inlet and thermal element extend along at least 50% of the periphery of the first face; and wherein the air outlet and the airflow passage are arranged such that, in use, the airflow velocity through the airflow passage at the thermal element is less than 50% of the airflow velocity through the airflow passage at an output of the fan, wherein the thermal element is mounted to a first housing portion of the main body and the fan is mounted to a second housing portion of the main body, the second housing portion being hinged with respect to the first housing portion, wherein the second housing portion is rotatable via the hinge with respect to the first housing portion from a first position to a second position, and wherein the fan is operable for normal use in the first position and is accessible for maintenance in the second position.

16. An air conditioning unit according to claim 1, wherein the main body of the air conditioning unit is mounted in a vertical wall with the first face vertical and exposed to the temperature controlled space.

17. An air conditioning unit according to claim 16, wherein the main body of the air conditioning unit has a thickness in the range of 250 mm to 300 mm.

18. An air conditioning unit according to claim 1, further comprising an air filter, wherein the air filter is releasably mounted within the first housing portion such that it cannot be removed from the first housing portion when the second housing portion is in the first position, and can be removed from the first housing portion when the second housing portion is in the second position.

* * * * *